United States Patent [19]

Braddick

[11] Patent Number: 4,898,245

[45] Date of Patent: Feb. 6, 1990

[54] RETRIEVABLE WELL BORE TUBULAR MEMBER PACKER ARRANGEMENT AND METHOD

[75] Inventor: Britt O. Braddick, Houston, Tex.

[73] Assignee: Texas Iron Works, Inc., Houston, Tex.

[21] Appl. No.: 314,158

[22] Filed: Feb. 27, 1989

Related U.S. Application Data

[63] Continuation of Ser. No. 186,869, May 10, 1988, abandoned, which is a continuation-in-part of Ser. No. 7,786, Jan. 28, 1987, abandoned, which is a continuation-in-part of Ser. No. 912,320, Sep. 29, 1986, abandoned.

[51] Int. Cl.[4] ..... E21B 23/08

[52] U.S. Cl. ..... 166/387; 166/123; 166/134; 294/86.34

[58] Field of Search ..... 166/98, 119, 123, 124, 166/125, 134, 138, 182, 387, 114, 116; 294/86.26, 86.27, 86.34

[56] References Cited

U.S. PATENT DOCUMENTS

| | | | |
|---|---|---|---|
| 3,678,998 | 7/1972 | Cockrell et al. | 166/123 |
| 3,944,273 | 3/1976 | Ahlstone | 294/86.34 X |
| 3,976,133 | 8/1976 | Allen | 166/120 |
| 4,248,300 | 2/1981 | Braddick | 166/250 |
| 4,368,911 | 1/1983 | Pringle | 294/86 |
| 4,437,516 | 3/1984 | Cockrell | 166/120 |
| 4,516,634 | 5/1985 | Pitts | 166/120 |
| 4,582,135 | 4/1986 | Akkerman | 166/134 |
| 4,610,300 | 9/1986 | Mullins, II et al. | 166/134 |
| 4,638,860 | 1/1987 | Magee, Jr. et al. | 166/114 |
| 4,648,445 | 3/1987 | Caskey | 166/98 |
| 4,648,455 | 3/1987 | Caskey | 166/98 |
| 4,690,220 | 9/1987 | Braddick | 166/382 |

OTHER PUBLICATIONS

"TIW SS-R Retrievable Packer", Texas Iron Works, Inc. Catalog, p. 31, 1983.

"TIW SS Retrievable Packer", Texas Iron Works, Inc., Blue Print No. I-1016, dated 10/11/83.

1974–75, Composite Catalog of Oil Field Equipment and Services, pp. 394, 395, 404, 405, 408, 3924, 3925 and 3932.

*Primary Examiner*—William P. Neuder

*Attorney, Agent, or Firm*—Jack W. Hayden

[57] ABSTRACT

A retrievable packer arrangement that can be used as a permanent production packer employs a simple compression set packer which can be either mechanically, hydraulically or wireline explosively set and retrieved by coupled or coiled pipe or wireline.

The arrangement includes an adapter supported by the setting tool which surrounds an external seal surface on the upper end of an inner tubular member which seal surface is exposed after the packer arrangement is set in a well bore tubular member by release of the setting tool from the inner member and removal of the adapter therewith, so that a production string may then sealingly telescope over the inner member upper end.

An outer member includes release means adjacent its upper external end including an external grapple engaging surface means so that the packer arrangement can be released without engaging the packer or slips which secure the packer arrangement in the tubular member and without inserting any mechanism in the set packer arrangement.

The packer arrangement provides an unrestricted bore for well tools and flow from the well.

The invention also contemplates lowering a landing nipple into a well bore tubular member to a desired location and sealably anchoring it at that location by a retrievable packer, for subsequent removal by a grapple tool supported on pipe or a wireline.

36 Claims, 9 Drawing Sheets

ST
17
WS
18
15
11
10
16
A
19
20
21
I 38
98
35
100
58
22
31
66
68
67
O
34
60
61
65
59
60a
48
42
L
53
50
1D
52
54
40

O
69
68a
P
70
E
72
71
73
85
C
74a
86
82
74
S
76
S
76'
80
82'
88
89
I

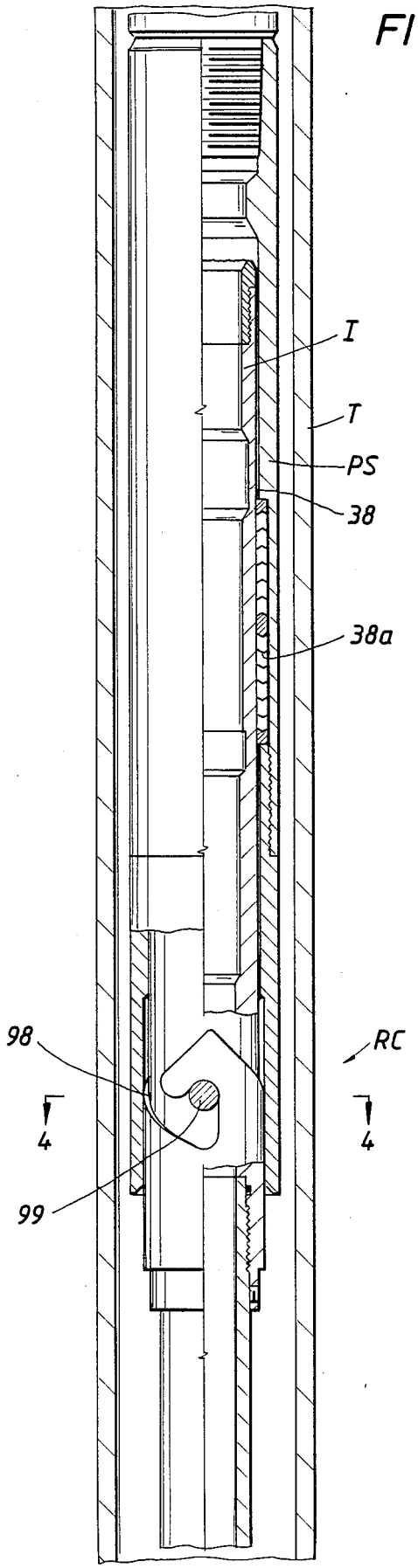
FIG. 3
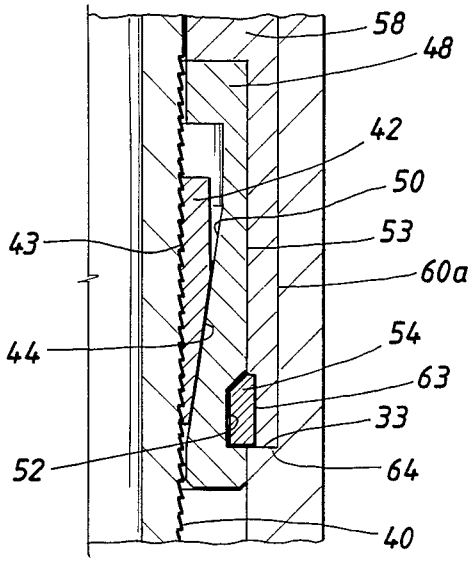
FIG. 1D
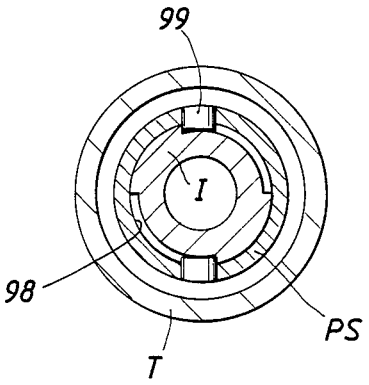
FIG. 4
FIG. 6
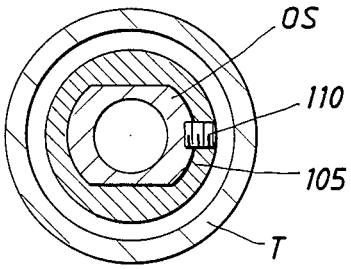

WS
ST
110'
17
18
16
15
19
20
A
21
I
38
0
22
31
S
P

CT
D
WS
ST
18
146
147
17
16
19
15
20
B
A
BS
21
38
I
0
22
31
S
P

D
WS
ST
18
17
16
15
19
21
20
A
38
I
0
22
31
S
P

ST
113
111
112
114
115
112'
116
117
141
110'
119
140
120
120
121
122
123
142
15
A

21
A
I
38
98
100
35
58
0
66
67
68
60
34
65
61
48
59
43
4
42
50
44
L
54
60a
12
63
64
40

85
86
74a
125
76
S
76'
126
C
88
89
130
131
131a
P
133a
131b
132
133b
134
133
133c
133f
133d 21
38
T
T
100
35
58
O
66
67
68
60
T
34
65
61
59
60a
63
64

D
T
C
125
76
S
76'
126
130
131
131a
P
133a
133f
133
134
13
133c 21
145
38'
PS
38a
38
RC
99
98
13
T
T
100

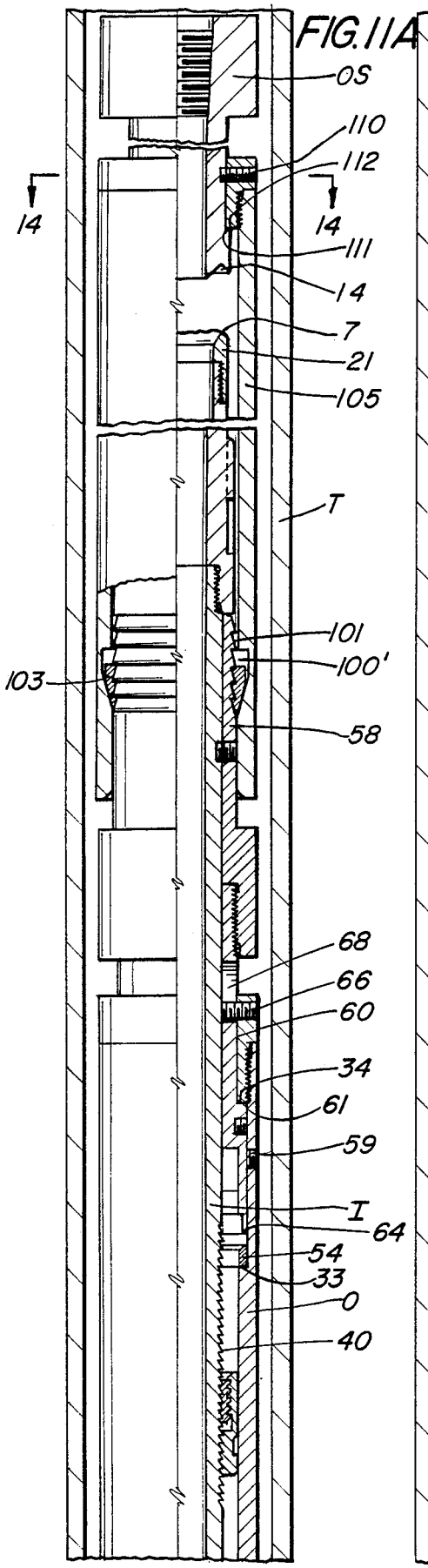
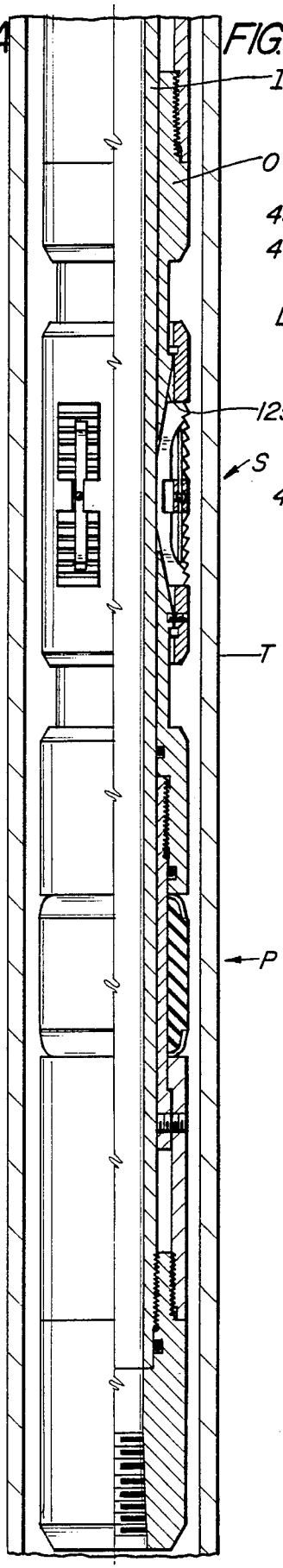
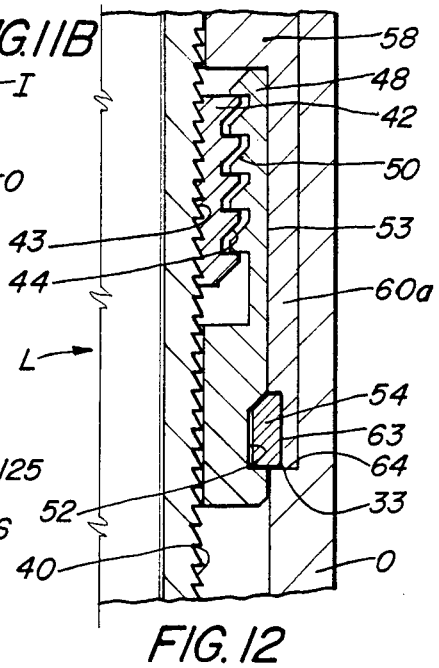
FIG. 12
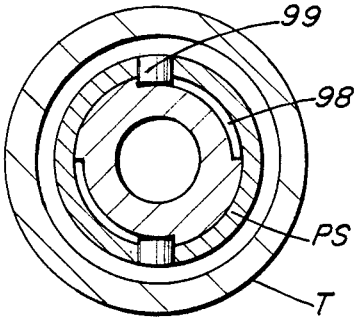
FIG. 13
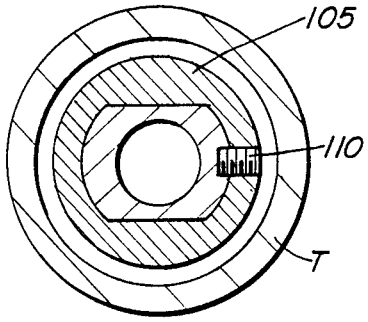
FIG. 14

RETRIEVABLE WELL BORE TUBULAR MEMBER PACKER ARRANGEMENT AND METHOD

CROSS REFERENCE TO RELATED APPLICATIONS

This is a continuation of co-pending application Ser. No. 186,869 filed May 10, 1988 for "Retrievable Well Bore Tubular Member Packer Arrangement and Method" now abandoned, which is a continuation-in-part of prior copending application Ser. No. 007,786 filed Jan. 28, 1987 for "Retrievable Well Bore Tubular Member Packer Arrangement and Method" now abandoned which is a continuation-in-part of prior copending application Ser. No. 912,320 filed Sept. 29, 1986 for "Retrievable Well Bore Tubular Member Packer Arrangement" now abandoned.

FIELD OF THE INVENTION

This invention relates to a packer arrangment for a well bore. It may be employed as a permanent production packer or as a retrievable packer, in any size tubular member. It also has particular application in conjuction with small diameter production strings which enables production packers associated with such production string to be positioned in a well bore tubular member then readily retrieved by a wireline, or if desired, coiled or coupled pipe.

DESCRIPTION OF THE PRIOR ART

Various types of permanent and retrievable production packers have been heretofore employed. Some of such packers and packer arrangements are shown in the 1974–75 Composite Catalog of Oil Field Equipment and Services at pages 394, 395, 404, 405, 408, 3924, 3925, 3932 and 3933.

The packer construction employed with prior art packer arrangements has heretofore been dependent upon whether the packer was to be set by mechanical, hydraulical or wireline means. Requiring a special or different packer thus required a substantially larger inventory for satisfying all customers preferences. Some packer arrangements also were subject to premature actuation as they were lowered in the well bore since well bores may actually be helical causing the packer arrangements to actuate during lowering operations on a coupled well string (a well string formed of pipe joints connected together by couplings).

Also, permanent production packer arrangements generally had to be milled or cut out when it was desired to remove them. Further, applicant is not aware of any retrievable packer arrangement that can be set either mechanically , hydraulically or explosively on a wireline and then retrieved either by coupled pipe, or continuous pipe (pipe coiled on a drum) or a wireline, or a packer arrangement which can be so actuated and retrieved that employs the same packer construction without regard to the type setting tool.

It has heretofore generally been the practice to employ nonretrievable, permanently set production packers where small internal diameter production strings are employed which require the use of milling tools to mill or cut the packers when it is desired to remove them from the tubular member in which they are positioned. This operation is quite expensive and time consuming. While, as noted, the present invention may have application in any size diameter tubular members as production strings, it does have particular application in connection with small diameter production strings in that it is constructed and arranged to enable its release and retrieval from the well bore tubular member without attempting to introduce mechanisms internally of the packer arrangement, or adjacent the packer and slips which are expanded into sealing engagement with the tubular member. Release and retrieval of the present invention is effected by engaging the exterior of the packer arrangement adjacent the upper end above the set packer and slips.

SUMMARY OF THE INVENTION

The present invention overcomes the above and other problems. For example, the same packer may be employed in any packer arrangement, whether it is to be hydraulically, mechanically or explosively set. Explosively set mechanisms can be run into the well bore on a wireline. If the packer arrangement is hydraulically set, continuous coiled tubing (pipe coiled on a drum) may be employed which does not require the use of a drilling mast or workover mast to lower the packer arrangement into the well bore tubular member which is required to mechanically set a packer. Regardless of how the packer arrangement of the present invention is initially set, it can be retrieved by a wireline or coiled tubing without the use of a drilling mast at the well location. If desired, it may be also retrieved with coupled pipe which requires the use of a drilling mast to enable joints of pipe or tubing to be coupled together as the well string is lowered into the well bore in a werr known manner.

In addition, the packer arrangement includes inner and outer tubular members which can be manipulated either hydraulically, explosively, or by a mechanical setting tool to quickly and readily expand the packer into sealing engagement with a well bore tubular member. It is secured in sealing position by slip means which lockingly engage the tubular member. An external seal engaging surface is provided adjacent the upper end of the inner member which becomes exposed for sealing engagement with a production string lowered into the well bore to surround the inner member upper end after the packer arrangement has been set. An external grapple engaging surface means is provided adjacent the upper end of the outer tubular member above the set packer arrangement for engagement by a grapple tool on a wireline, coiled or coupled pipe for release and retrieval of the packer arrangement, thus eliminating the necessity of trying to engage any internal mechanism to release the packer arrangement.

An object of the present invention is to provide a retrievable packer arrangement which employs a relatively simple compression set packer and the same type packer can be employed with either mechanical, hydraulic or wireline setting tool for sealingly positioning the packer in a well bore tubular member. The packer arrangement can be retrievable with either a coupled pipe string, coiled pipe string or wireline.

Another object of the present invention is to provide a retrievable packer arrangement which employs a relatively simple compression set packer and the same type packer can be employed with either a mechanical, hydraulic or wireline setting tool for sealingly positioned the packer in a well bore tubular member and wherein the packer sealingly engages the well bore tubular member below the slips that secure the packer to the well bore tubular member whereby contact by well bore fluids from below the packer which might foul the slips and make it difficult to release them is substantially lessened, if not eliminated. The packer arrangement can be retrieved with either a coupled pipe string, coiled pipe string or wireline.

A still further object of the present invention is to provide a retrievable packer arrangement which employs a relatively simple compression set packer and the same type packer can be employed with either a mechanical, hydraulic or wireline setting tool to be positioned in a well bore tubular member and which packer arrangement includes an inner member with an external seal engaging surface that is exposed after removal of the setting tool to telescopically receive therearound a production string to communicate well fluids through the packer arrangement to the earth's surface. The packer arrangement can be retrieved with either a coupled pipe string, coiled pipe string or wireline.

An object of the present invention is to provide a retrievable packer arrangement which employs a relatively simple compression set packer and the same type packer can be employed with either a mechanical, hydraulic or wireline setting tool to be positioned in a well bore tubular member and wherein the packer sealingly engages the well bore tubular member below the slips which aid in sealingly securing the packer to the well bore tubular member whereby contact by well bore fluids from below the packer which might foul the slips and make it difficult to release them is substantially lessened if not eliminated, the slips comprising at least two annular rows of segments and the packer arrangement including means to selectively set the uppermost row of slip segments prior to setting the lower row of slip segments. The packer arrangement can be retrieved with either a coupled pipe string, coiled pipe string or wireline.

An object of the present invention is to provide a retrievable packer arrangement which employs a relatively simple compression set packer and the same type packer can be employed with either a mechanical, hydraulic or wireline setting tool to be positioned in a well bore tubular member and which can be retrieved with either a coupled pipe string, coiled pipe string or wireline by engaging an external grapple means adjacent the upper end of the packer arrangement with a grapple tool including jar means to aid in releasing the packer arrangement for retrieval.

Yet a further object of the invention is to provide a retrievable packer arrangement including inner and outer tubular members secured against movement as they are lowered into the well bore with the inner member having a seal engaging surface adjacent its upper end which is surrounded by an adapter while the packer arrangement is lowered and positioned in a well bore tubular member and then the adapter removed to expose the seal engaging surface for telescoping engagement into a production string. The outer member is provided with an external grapple engaging surface adjacent its upper end for engagement by a grapple tool to release and retrieve the packer arrangement. The packer arrangement can be set mechanically, hydraulically or explosiviely by wireline and retrieved by either wireline, coiled or coupled tubing as desired.

Accordingly, it is another object of the present invention to provide a retrievable packer arrangement for use particularly with small diameter production strings in which the internal bore may be restricted so that access to the packer setting arrangement for release is limited thus making retrieval difficult, if not impossible, in some situations. It also has application to any size tubular production string member, and is constructed and arranged so it may be lowered into the well bore on a well string along with a setting tool which may be explosively actuated, or hydraulically or mechanically actuated to sealably secure a packer in engagement with a well bore and tubular member, and to expose the upper end of the packer arrangement which has an external seal surface for sealably receiving the production string thereover that is lowered into the well bore and releasably engaged therewith.

A still further object of the present invention is to provide a method of positioning a landing nipple with recess means therein in a well bore well string which has no landing shoulder to receive the landing nipple and which well string has a larger diameter than the diameter of a production string thereafter positioned in the well string whereby retrievable plug means and/or instrument means may be seated in the landing nipple to selectively and instrumentally measure well bore conditions and/or block flow from the well bore to the production string comprising the steps of lowering an upwardly open receptacle into the well bore and securing it to the well string, lowering retrievable packer means with landing nipple means depending therefrom into and securing the packer means in position in the upwardly open receptacle and lowering a production string into the well string and sealably engaging it within the upwardly open receptacle above the packer means.

An object of the present invention is to provide a method of positioning a landing nipple in a liner in a well bore well string which has no landing shoulder to receive the landing nipple and which well string has a larger diameter than the diameter of a production string thereafter positioned in the well string whereby a retrievable plug may be seated in the landing nipple to block flow from the well bore to the production string comprising the steps of lowering an upwardly open receptacle into the well bore and securing it to the well string, lowering packer means with landing nipple means depending therefrom into and sealably securing it in position in the upwardly open receptacle, applying fluid pressure to the sealably secured landing nipple to test for leaks and lowering a production string into the well bore and sealably engaging it within the upwardly open receptacle, lowering a retrievable plug through the production string to engage in the landing nipple beneath the production string to block flow from the well bore to the production string, elevating the production string to sealably disengage it from upwardly facing receptacle and circulating fluid above the plug between the well string and production string.

The packer arrangement also includes a grapple surface means adjacent its upper outer end which may be engaged by a grapple tool lowered into the well bore when it is desired to release and retrieve the packer arrangement, after first removing the production string from engagement with the upper end of the packer arrangement.

When the grapple tool is lowered into the well bore, it engages adjacent the upper end of the outer member and is constructed and arranged so that it may selectively apply dislodging forces to the inner and outer members to dislodge the slip means from engagement with the tubular member and enable the packer and slips to unset or release so that the packer arrangement can be removed from the well bore.

Other objects and advantages of the present invention will become apparent from consideration of the following description and drawings.

BRIEF DESCRIPTION OF THE DRAWINGS

FIG. 1D is a partial sectional view of FIG. 1B illustrating in enlarged, greater detail one form of the lock means;

FIG. 3 is a one-quarter sectional view showing a production string releasably and sealably connected with the inner tubular member seal surface;

FIG. 4 is cross-sectional view on the line 4—4 of FIG. 3 illustrating details of one form of releasable connection means between the production string and inner member;

FIG. 6 is a cross-sectional view on the line 6—6 of FIG. 5A showing the details of one form of means to enable the grapple means to selectively apply forces to the packer arrangement to disengage the packer and slips from the well bore tubular member for retrieval.

FIG. 8 is a one-quarter sectional view showing the details of a mechanical setting tool including a portion of the adapter releasably supported on the setting tool;

FIGS. 8A and 8B are one-quarter sectional views that are continuations of FIG. 8 showing in FIG. 8A the upper ends of the inner and outer tubular members, the adapter surrounding the external seal surface on the inner member; the grapple engaging surface means on the outer tubular member upper end other details, while FIG. 8B illustrates the preferred relationship of the packer and slip means; FIG. 8A and 8B also show the details of the form of the invention which are employed with the hydraulic setting tool and explosively actuated setting tool schematically shown in FIGS. 7b and 7C respectively;

FIGS. 11A and 11B are one-quarter sectional views showing the FIGS. 8A, 8B form after it is released for retrieval;

FIG. 12 is a partial section of FIG. 8A illustrating in enlarged form and greater detail of a preferred form of the lock means;

FIG. 13 is a cross-sectional view on the line 13—13 of FIG. 10 and is similar to FIG. 4;

FIG. 14 is a cross-sectional view on the line 14—14 of FIG. 11A and is similar to FIG. 6;

DESCRIPTION OF THE PREFERRED EMBODIMENTS

Figure 1A:
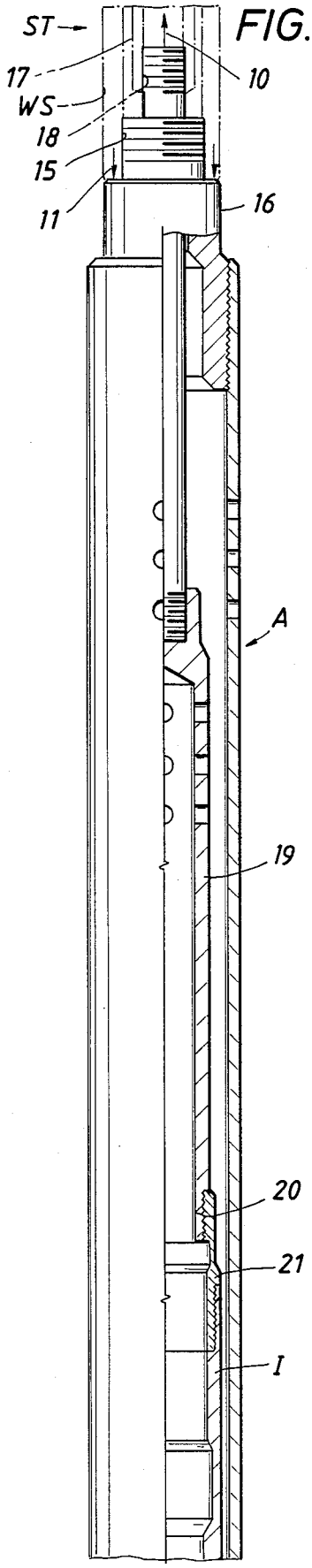
FIGS. 1A, FIG. 1B and FIG. 1C are longitudinal one-quarter sectional views illustrating an embodiment of the present invention for use with a hydraulically or explosively actuated setting tool. The views show the assembled packer arrangement in position for lowering into a well bore tubular member to set the packer and slip means in sealing and securing relationship with the well bore tubular member.
Figure 1B:
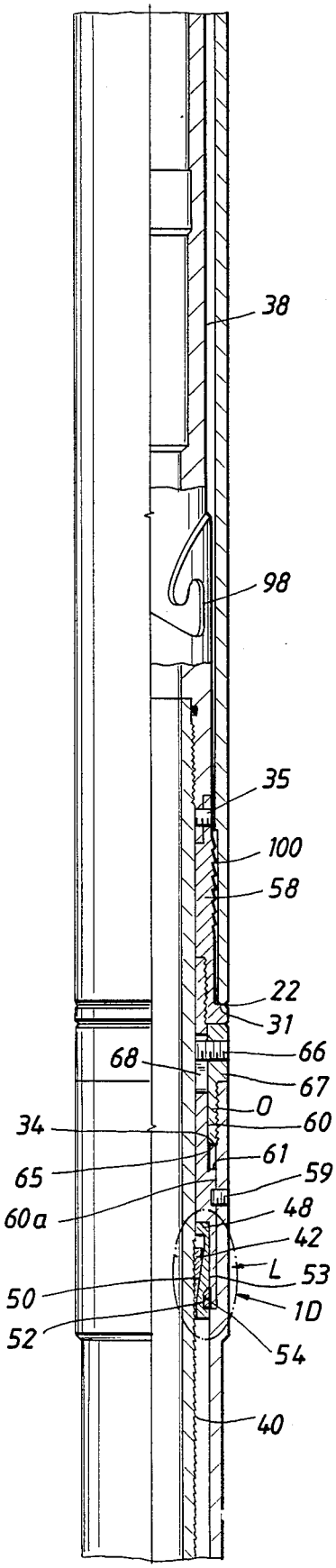

Attention is first directed to FIGS. 1A, FIG. 1B, FIG. 1C, FIG. 7A, FIG. 7B and FIG. 7C wherein a setting or well string WS including a setting tool is schematically illustrated at the upper end of FIG. 1A, 7A, 7B and 7C and represented generally by the letters ST. The setting tool portion of the setting string is connected to an inner tubular member I and supported on an outer tubular member O by the adapter A as illustrated in FIGS. 1A, 1B, 7A, 7B and 7C. The setting tool ST may be considered part of the inner member I as the packer arrangement is lowered into the well and actuated by the setting tool mechanism referred to generally at 17. A lock means referred to generally by the letter L in FIGS. 1B and 8A is associated with the inner and outer members to maintain the packer means represented generally at P and slips S generally supported on the outer member O sealably engaged and secured, respectively, with a well bore tubular member T as will be described. The well bore tubular member T is shown in FIGS. 2A, 2B, 3 through 6; FIGS. 9A, 9B, 10, 11A, 11B, 13 and 14.

Figures 7A, 7B, 7C:
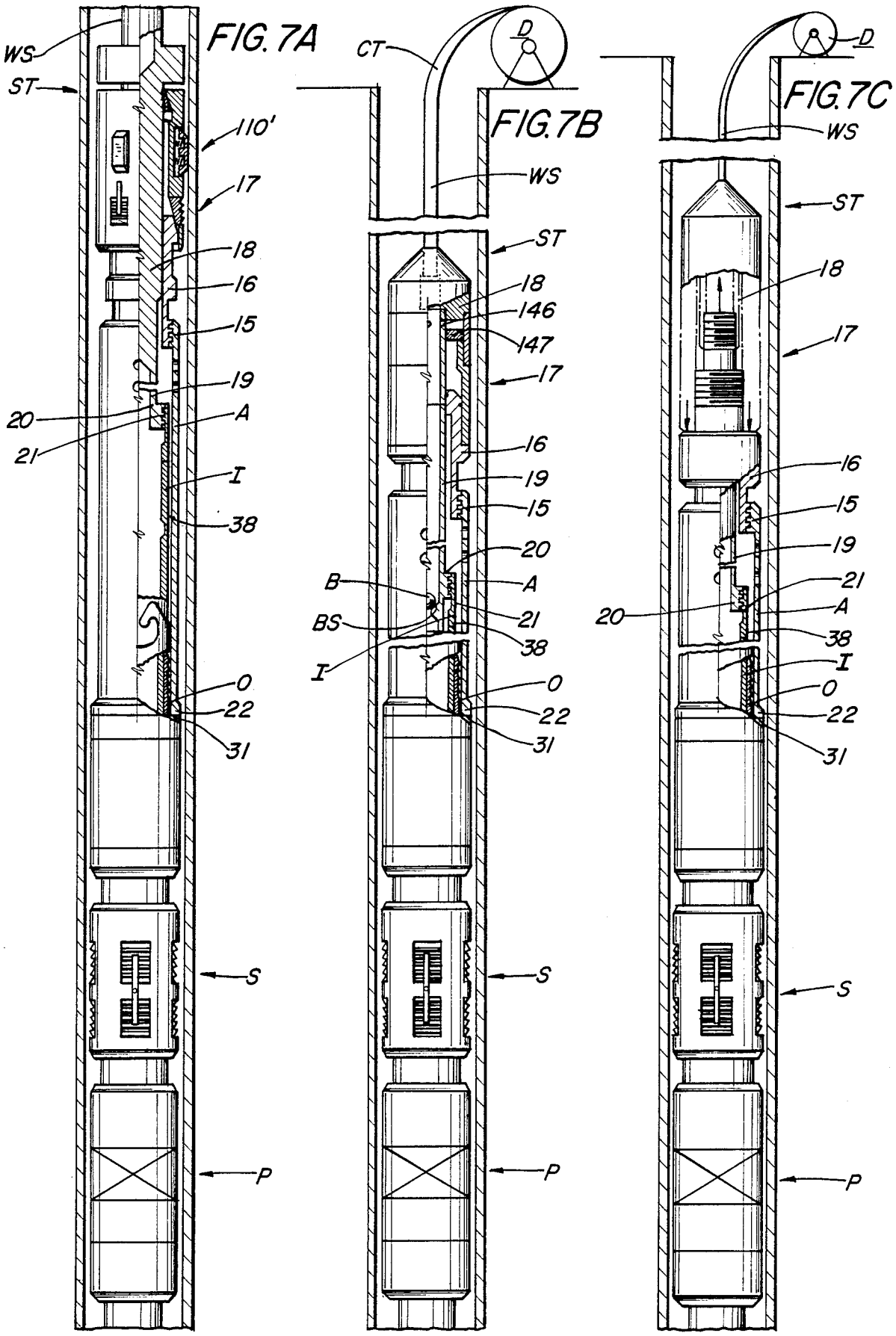
FIGS. 7A, 7B and 7C are schematic elevations, partly in section of a preferred form of the invention illustrating respectively the invention with a mechanical setting tool which normally employs coupled pipe; the invention with a hydraulic setting tool with which coiled pipe may be employed; and the invention with an explosively actuated setting tool with which a wireline including an electrical conduit is employed for setting the packer arrangement.
Figures 8, 8A, 8B:
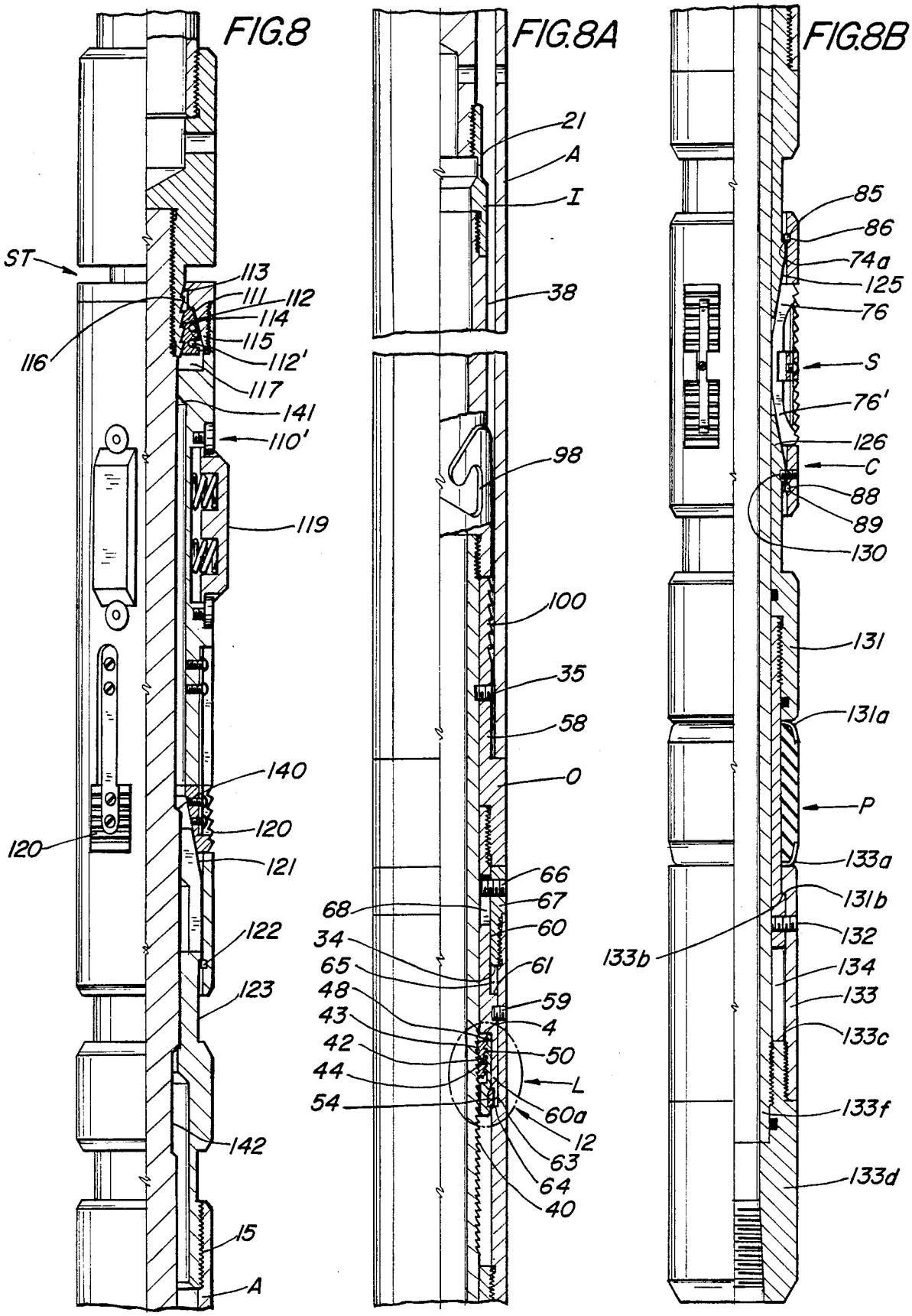

The setting string WS with the setting tool ST thereon may be lowered along with the structure shown in FIGS. 1A, 1B, 1C, 7A, 7B or 7C into the well bore and may be considered part of well string WS. The well string WS may be either coupled pipe, that is joints of pipe connected by couplings; a continuous length of pipe, that is pipe coiled on a drum D such as represented in FIG. 7B; or it may be a wireline coiled on drum D as represented in FIG. 7C, the latter also including an electric line to operate the explosively actuated setting tool schematically represented in FIG. 7C.

An adapter A is supported in any suitable manner on the mechanical, hydraulic, or wireline setting tool of the drawings by any suitable means such as by the setting tool portion represented at 16 and 20 that is engaged with the adapter A in any suitable manner as represented at 15 and 21. The adapter is retrieved with the setting tool after the packer arrangement has been sealably in the well bore tubular member T.

The actuating mechanism of the setting tool represented in dotted line in FIGS. 1A and schematically in FIGS. 7A–7C at 17 is connected by any suitable means such as the arrangement 18 to the portion 19 of inner member I that extends longitudinally within the surrounding adapter A. The portion 19 is connected at its lower end 20 to a shear release sleeve and/or rotational release mechanism 21 adjacent the upper end of the inner tubular member I. The lower end 22 of adapter A rests on or is adjacent the annular shoulder 31 adjacent the upper end of outer tubular member O.

Figure 1C:
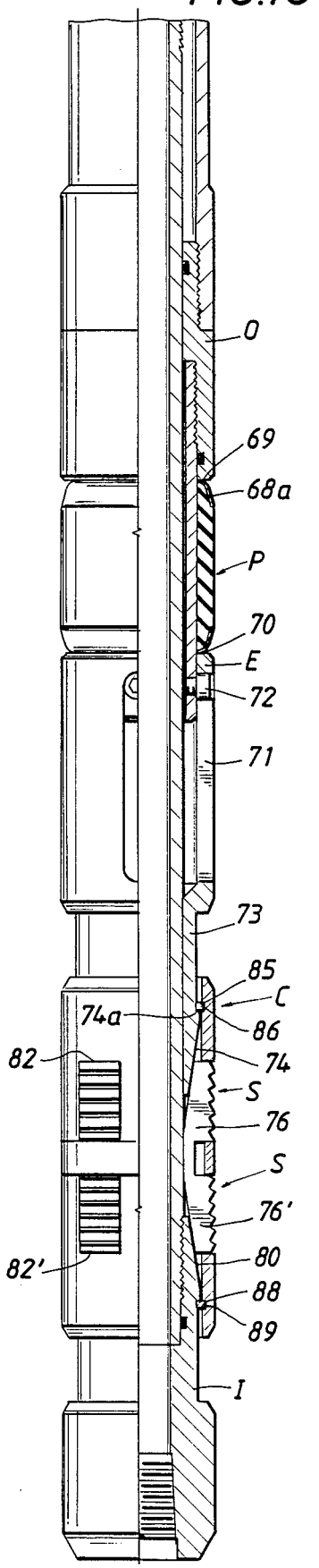

As previously noted, the actuating mechanism 17 of the setting tool ST may be explosively actuated, hydraulically actuated or mechanically actuated whichever may be desired. FIGS. 1A–1C; and FIGS. 7C, 8A, 8B, respectively, illustrate two forms of the explosively set packer arrangement; FIGS. 1A–1C, 7B, and FIGS. 8A, 8B illustrate two forms of the hydraulic set packer arrangement and FIGS. 7A, 8, 8A and 8B illustrate the form of the mechanical set packer arrangement. The setting tools details are generally well known to those skilled in the art and no detailed description is deemed necessary as to their detailed structure and function.

Figures 9A, 9B, 10:
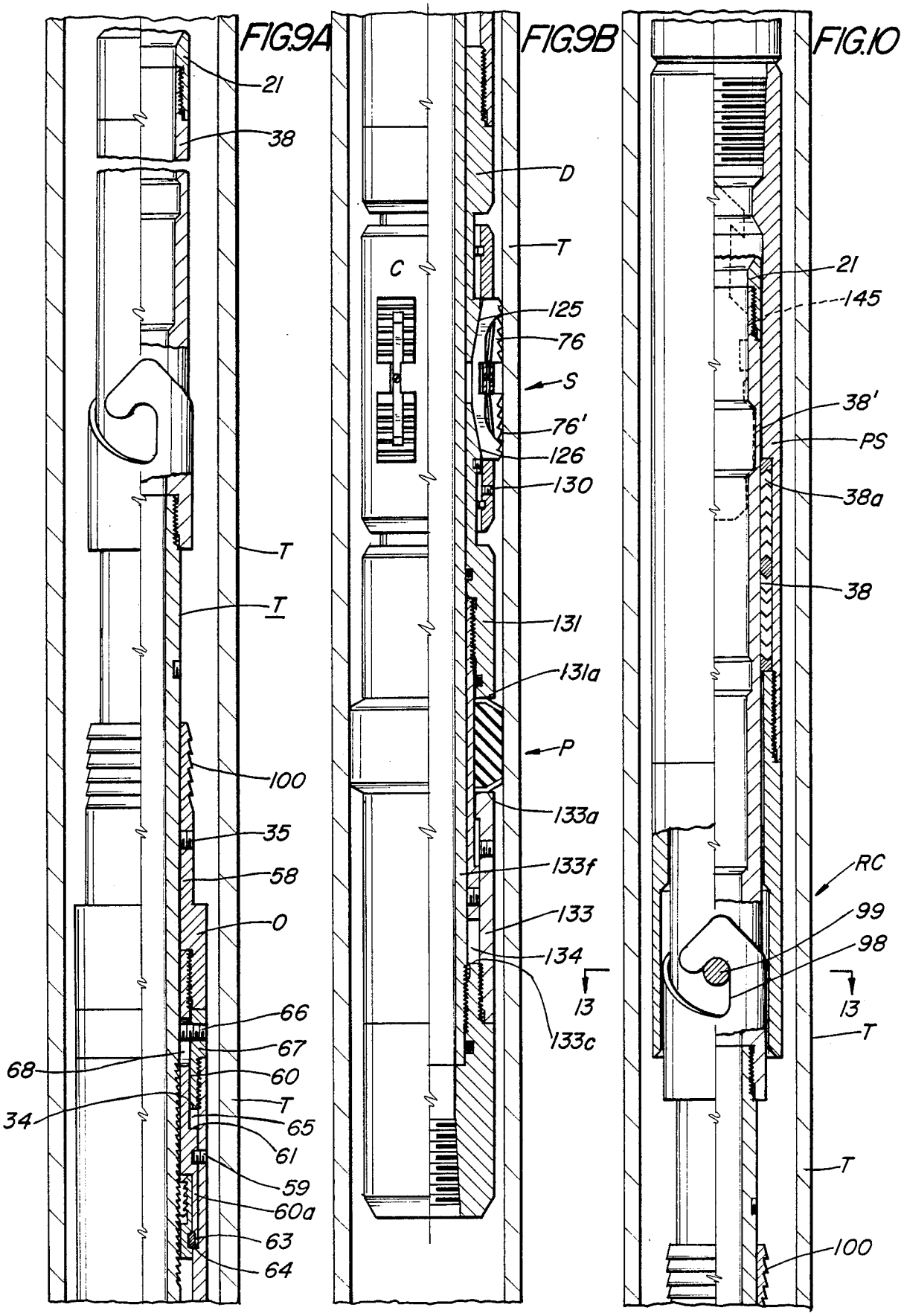
FIGS. 9A and 9B are one-quarter sectional views showing the relationship of the components of the form invention of FIGS. 8A, 8B after it has been secured in the well bore tubular member either by a mechanical, hydraulic or explosive wireline setting tool, respectively, as shown by FIGS. 7A-7C.
FIG. 10 is a one-quarter sectional view showing the production string surrounding the inner seal surface.

When the inner tubular member I and outer tubular member O are assembled for lowering into the well bore tubular member T, they are initially releasably connected together against relative longitudinal movement as they are lowered to position in the well bore tubular member T by suitable means such as the shear pin 35 adjacent the upper end of the inner member I and outer member O above the lock means L, the packer means P and slips S. The inner member I is provided adjacent its upper end with an external seal surface 38 formed by any suitable means for sealably receiving therearound the lower end of the production string PS as shown in FIG. 10 for communicating fluid flow from a producing formation through the set packer arrangement as shown in FIGS. 2A, 2B, 9A and 9B to the production string PS as shown in FIGS. 3 and 10 for flow to the earth's surface. The production string PS is provided with internal seal means **38*a* for sealably engaging longitudinal seal surface 38. The adapter A extends over and surrounds the external seal surface 38** on the inner member I as the packer arrangement is lowered into the well bore and secured with the tubular member T and thus inhibits damage to the seal surface during operations.

The lock means L includes a ratchet surface 40 on the outer periphery of the inner member I that extends longitudinally thereof. A split or segmented ratchet ring 42 having a ratchet surface 43 on its inner periphery and outer annular tapered surface means 44 abuts a ratchet ring support 48 which is provided with an internal tapered annular surface means 50 conforming with the tapered surface means 44 on the ratchet ring 42. It will be noted that in FIGS. 1B, 1D, and 2A a single taper forms the surface means 44 and 50, while a plurality of tapered surfaces form the surface means in FIGS. 8A, 9A, 11A and 12. The multiple taper form is preferred as it provides less back-off movement between the inner and outer members after the packer P is compressed and thereby attains a somewhat better sealing relationship of the packer and a better securing relationship by the slips S.

Figure 5A:
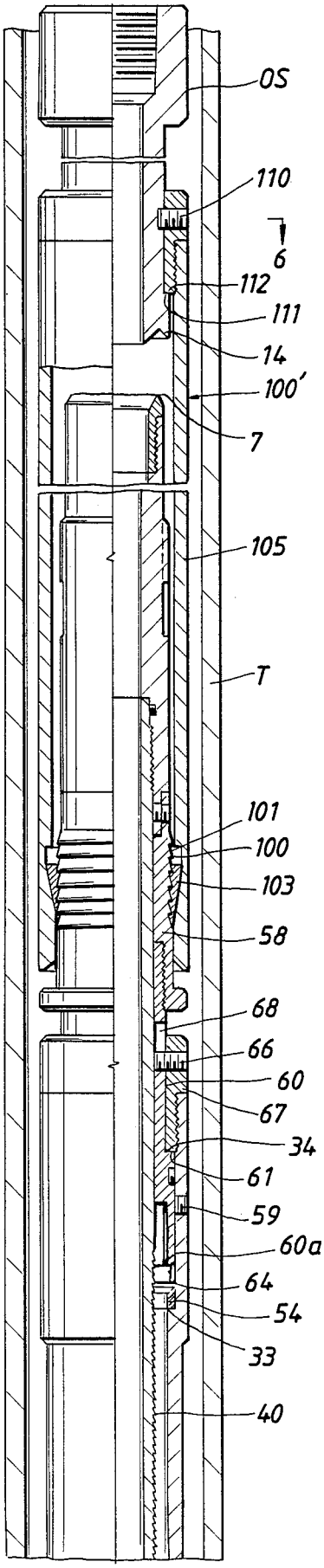
FIGS. 5A and 5B are one-quarter sectional views showing the position of the components when a grapple means has actuated the release means of the lock means and disengaged the packer and slip means of the FIG. 1B and 1C form from the well bore tubular member for retrieval.

An annular groove 52 is formed in the outer circumferential surface 53 of the ratchet ring support 48 and receives therein a split spring lock ring 54 which may be formed to tend to expand out of engagement with the groove 52, but which lock ring is retained in position in the groove 52 by the release means 58 when the lock means and release means is in the position shown in FIGS. 1B, 2A, 8A, and 9A. The top surface of ring 54 and the top or upper surface of groove 52 may be shaped as shown in FIGS. 1D and 12 to tend to urge the ring 54 out of groove 52 when release means in the form of sleeve means 58 is shifted to a second position as shown in FIGS. 5A and 11A.

The release means 58 cooperate with lock means L when in the position shown in FIGS. 1B, 2A, 8A and 9A to ihibit release of the lock means L. Manipulation of the outer member O shifts the release means to a second position to enable lock ring 54 to move out of groove 52 as will be described.

The outer member O includes the release sleeve means 58 which projects above and is telescopically received in the upper end of outer member O as shown in FIGS. 1B, 2A, 5A, 8A, 9A and 11A, the sleeve means 58 being releasably coupled with the remainder of the outer member O by the shear pin 59. The sleeve means 58 includes a longitudinally extending, annular portion 60 of reduced diameter providing or forming an annular upper shoulder 61 on the sleeve means 58. The lower end 64 of sleeve means 58 formed on portion **60*a* adjacent the lock means L when the lock means is engaged provides a lower annular shoulder. A counterore 63 extends from lower end or shoulder 64 which counterbore receives the lock ring 54 when the components of the lock means are assembled for lowering in the well bore shown in FIGS. 1B and 8A of the drawings. The lower shoulder end 64 of the sleeve means 58 rests on the lower annular shoulder 33 formed in the outer member O as better seen in FIGS. 1D and 12. The longitudinal extent on the sleeve means 58 between the lower shoulder 64 and upper shoulder 61 is of less longitudinal extent than the distance between the lower shoulder 33 and upper annular shoulder 34 formed on the outer member O thereby providing a longitudinal annular space 65 between the shoulders 61 and 34 to accommodate relative longitudinal movement of the sleeve means 58 along inner member I and relative to the remainder of the outer member O as will be described. The lower shoulder end 64 of the sleeve means 58 is of less width or extent than the lower shoulder 33 on outer member O, so that the lock ring 52, overhangs the shoulder 33 to rest thereon as shown in FIGS. 1B, 2A, 1D, 8A, 9A and 12**.

The pin 66 positioned in the portion 67 of the outer member extends into the slot 68 formed in the sleeve means 58 and accommodates relative movement between the sleeve means 58 and the remainder of the outer member O when the shear pin 59 is sheared to accommodate such longitudinal movement while preventing relative rotation therebetween.

In the FIGS. 1A–1C form, an extension E is supported on the outer member O beneath the lock means L and packer P and depends from the lower end of the outer member O. The cage means C is supported on the extension E adjacent its lower end and depends therefrom as shown in FIG. 1C.

The upper end 70 of the extension E abuts or is adjacent the lower end of packer means P and the upper end 68a of the packer P is abutted against the ledge or shoulder 69 formed on the outer tubular member. The packer means P is shown as being single packer but it can be appreciated that additional packers may be employed as desired. The packers are of the compression type, which expand upon compression. The same packer is employed with all forms of the invention.

A plurality of longitudinally extending, circumferentially spaced slots 71 are provided in the extension E forming part of outer tubular member O and engaged therein are pins 72 secured to and projecting from the outer member which extend into slots 71 and support the extension E on the outer member O for relative longitudinal movement therebetween. The lower end of the extension E terminates in the downwardly facing annular conical surface 74 as shown.

The inner tubular member I is provided adjacent its lower end with the annular upwardly facing conical surface 80 and when the components of the packer arrangement are assembled, the upwardly facing conical surface 80 is adjacent, but longitudinally spaced relative to the downwardly facing conical surface 74 and receives therebetween the upper and lower annular rows of slip segments 76, 76' which may be joined together as shown, or separate, and are aligned with the openings or windows 82, 82' which extend longitudinally of and are circumferentially and longitudinally spaced in the cage C.

It will be noted that the cage C overlaps the upwardly and downwardly facing conical surfaces 80 and 74 respectively and the cage is supported on the extension E by the annular ring 85 which rests on shoulder 74a of extension E and which ring fits within the groove 86 in cage C. A similar ring 88 carried in groove 89 of cage C below lower slip 76' aids in maintaining the cage in position on the extension E when the slips are retracted as well as expanded and accommodates relative movement between the cage and inner and outer members.

In the FIGS. 7A and 8 form the mechanical setting tool includes a housing represented at 110'. It is supported on the setting tool by segmented nut 111 which has resilient means 112' surrounding the nut segments so that it may expand and contract. The inner annular surface of the nut segments 111 is threaded as shown at 112 to lock with threads 113 on the setting tool when in the position shown in FIG. 8. Conforming tapers 114 on the nut 111 and 115 on the housing 110' abut and cause nut 111 to collapse inwardly and move it into the groove 116 which causes the threads 112 on the nut segments to lock with the threads 113 on the setting string and tool ST. The longitudinal distance of space 117 in housing 110' which receives nut 111 is longer than the nut so that after the string WS has been rotated to unthread from housing 110', the setting string will automatically relock with the nut 111 when the string is lowered or moved toward the segmented nut 111 since the nut 111 may move down in space 117 and expand outwardly to engage threads 112 and 113. However, if the setting string is lowered when connected to housing 110', subsequent lifting will cause the housing and nut to cooperate and prevent separation or withdrawal of the setting string from the housing. This assists in maintaining inner tubular member I and outer tubular member O connected as the packer arrangement is lowered in the well bore to prevent separation of the setting string from the housing and accidental premature actuation and setting of the packer arrangement.

Spring loaded drag blocks 119 are carried on housing 110' and engage tubular member T (not shown in FIG. 8). The housing 110' is restrained relative to setting string WS upon rotation of the setting string WS by the blocks 119 so that the setting string WS can be threadedly disconnected from housing 110' by rotation of the setting string which rotates the remainder of the packer arrangement relative to restrained housing 110'. After disconnecting the setting string from housing 110', lifting up on setting string WS relative to housing 110', which housing will then be restrained against longitudinal movement with the setting string by blocks 119, causes the entire packer arrangement to move up relative to housing 110' so that slips 120 carried by housing 110' are contacted by conical surface 121 which moves up with the packer arrangement as the setting string is lifted. This urges slips 120 outwardly and into securing relationship with the adjacent tubular member T. Housing 110' is then secured with the tubular member T along with outer tubular member O since outer tubular member O is connected with housing 110' by the threads 15 on annular member 123. Ring 122 prevents separation of annular member 123 from the remainder of the setting tool ST therebelow while lowering in the well bore and enables the setting tool to be retrieved in its entirety after setting the packer. Conical surface 121 may be formed by a plurality of longitudinally extending, circumferentially spaced members or fingers extending from annular member 23 as shown to accommodate radial movement of conical surface 121 as will be described.

The inner tubular member I can then be pulled up by the setting string to shear pin 35 to release inner member I from outer member O. Continued tension in the setting causes upward movement of inner member I relative to outer tubular member O after shearing pin 35 and causes ratchet surface 40 thereon to move up relative to lock means L since the ratchet ring 48 moves to accommodate clearance of the threads on the inner member and the threads on the ratchet ring. The other components of the lock means L are held in place by ring support 48, lock ring 54 and the shoulder at the end of the recess formed in release sleeve 58 in which the lock means is positioned, as well as the other cooperating surfaces in the outer tubular member. The lock means L will act to lock the inner member in whatever elevated position results when the packer P and slips S are secured with the tubular member T.

The outer tubular member O extends from its upper end adjacent which the grapple engaging surface means 100 is provided and terminates in an annular downwardly facing conical surface 125. The inner tubular member extends through outer tubular member O, the cage C and packer P and is provided with an annular upwardly facing conical surface 126 longitudinally spaced from the lower end of inner member I and above packer means P as shown in FIG. 8B. The cage C is supported adjacent and spans the conical surfaces 125, 126 on inner and outer members as described with regard to FIG. 1C.

The slip rows 76, 76' illustrate slips that are connected; however, each row 76, 76' could be formed by separate slip segments supported in any suitable manner in the cage C. As shown a single spring tends to retain and urge the connected slips in each row toward the retracted position.

Suitable means are provided to set the top row of slip segments 76 prior to the lower row of slip segments 76'. Such means may be of any suitable form and as illustrated includes shear pin 130 which secures the lower end of cage C with the inner member I to function as will be described.

The conical surface 126 is formed on inner member sleeve portion 131 which is releasably secured to inner member I by shear pin 132 below packer P. The portion 131 is also secured by shear pin 132 to inner member sleeve portion 133 which is radially spaced from inner tubular member I by the width of portion 131 extending therebetween. Sleeve portion 133 extends between packer P and sleeve **133*f* of inner member I and receives or supports packer P thereon as shown in FIG. 8B. The shoulders 131*b* and 133*b* on sleeve portions 131 and 133, respectively, interlock portions 131 and 133 together adjacent and below the packer P as shown. The lower end of sleeve portion 131 terminates in spaced relation to the shoulder 133*c* on end member 133*d* which connects portion 133 and longitudinal sleeve 133*f* of inner member I together. This forms longitudinal annular spacae 134 extending between the portion 133 and the sleeve 133*f* of inner member I as shown in FIG. 8B**. The foregoing forms what may be termed a slip connection.

The shear pin 130 which secures the lower end of cage C with the inner member I is weaker than shear pin 132 connecting sleeve portion 131 to sleeve portion 133 of inner member I so that sequentially pin 130 will shear first and then pin 132.

DESCRIPTION OF OPERATION

In the operation of the packer arrangement of the present invention shown in FIGS. 1A–6, it is assembled as above described and as shown in FIGS. 1A–1C inclusive for lowering into a well bore tubular member T. When the setting tool ST has been actuated, the components move to the respective positions illustrated in FIGS. 2A and 2B.

Figure 2A:
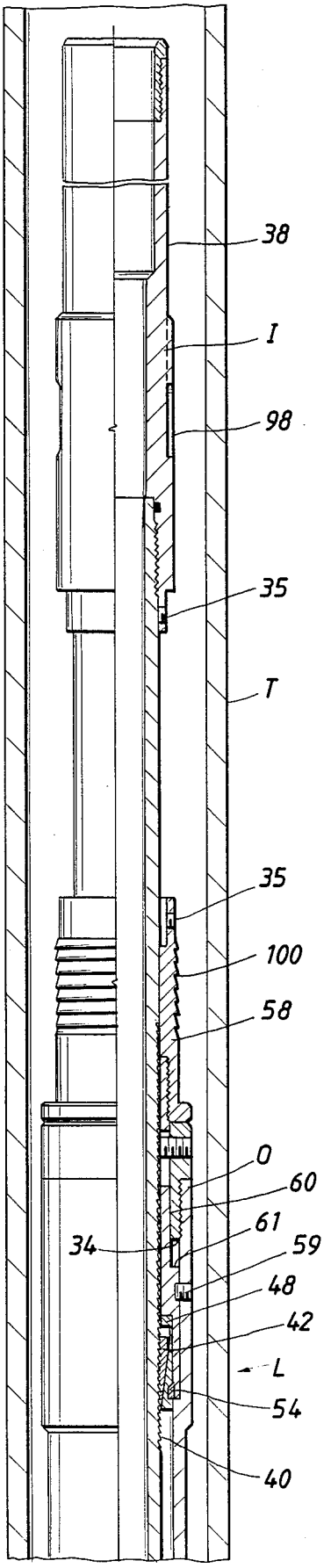
FIG. 2A and FIG. 2B are longitudinal one-quarter sectional views illustrating the relative position of components of the form of the present invention shown in FIGS. 1A-1C after longitudinal movement of the inner and outer tubular members has been effected to expand or move the packer and slips into sealing and securing relation with the well bore tubular member, expose the extermal seal surface adjacent the upper end of the inner tubular member and actuate the lock means to maintain the inner and outer tubular members in longitudinally moved relation for maintaining the packer and slip means engaged with the well bore tubular member.
Figure 2B:
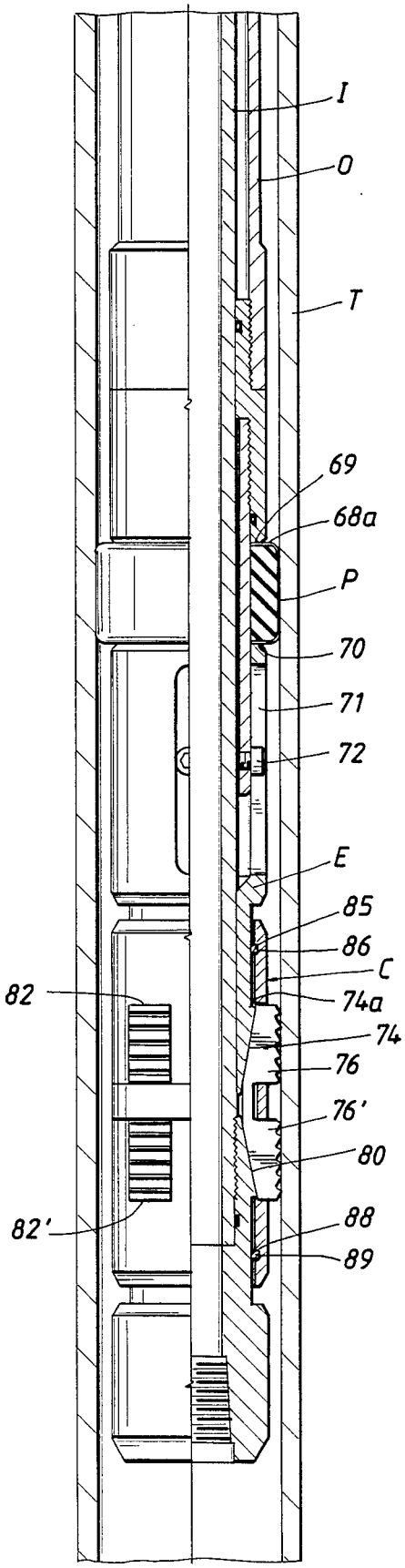

As previously noted, the actuating mechanism 17 may be either explosive or hydraulic actuated and when actuated, a force is applied as represented in FIG. 1A by the arrow 10 to the inner member I to apply tension thereto while the setting or well string WS applies a force to the adapter housing 16 as represented by the arrows 11 to shear pin 35 connecting the inner member I and outer member O together and release them for relative longitudinal movement due to the forces applied by the actuating or activating mechanism 17. When relative longitudinal movement between the inner member I and the outer member O caused by the setting tool ST occurs, the inner member I is moved upwardly as shown in FIG. 2A and positions the external seal surface 38 for subsequent sealing engagement with a production string PS when it is lowered into the well bore as shown in FIG. 3. Also, the relative longitudinal movement forces the packer P to expanded and sealed engagement with the well bore tubular member T as well as moving the slips 76, 76' onto the conical surfaces 74 and 80, respectively, to engage and secure with the well bore tubular member T as shown in FIG. 2B.

The downward movement of the outer member O relative to inner member I not only causes slip rows 76, 76' to engage well bore tubular member T, but also shifts outer member O downwardly and inner member I upwardly to expand packer means P into sealing engagement with the well bore tubular member T.

The up movement of inner member I shifts ratchet surface 40 thereon from the position shown in FIG. 1B to the position shown in FIG. 2A. The ratchet surface 40 on the inner member I and ratchet surface 43 on the split ratchet ring 42 accommodates longitudinal movement of the inner member I relative thereto and to the outer member O on which the lock means L is supported so that the ratchet ring 42 locks with the ratchet surface 40 on the inner member I after relative longitudinal movement between the inner and outer members from the initial postion of FIGS. 1A–1C to the second position demonstrated in FIGS. 2A and 2B to assist in retaining the packer means P expanded in sealing engagement and the slip rows 76, 76' moved to securing relationship with the tubular member T.

The shear ring 21 can be sheared by the activating mechanism 17 or by an additional tension in the well string 15 so that the portion 19 and adapter 16 is recovered with the setting string 15 and then a production string may be lowered into sealing engagement with the exposed seal surface of the packer arrangement of the present invention as illustrated in FIG. 3. In FIG. 3 the production string PS is shown as being provided with a releasable connection referred to generally by the letters RC between the external surface of the inner member I and the internal surface of the lower end of the production string, such releasable connection being illustrated as in the form of a J-slot referred to at 98 on inner member I which engages with the pin 99 on the production string in a well known manner so that the production string PS is releasably secured to the packer arrangement on the extermal surface on the inner member adjacent its upper end.

This arrangement does not provide any restrictions in the flow path through the packer arrangement, which restrictions where relatively small diameter production strings are employed can present serious problems.

The operation of the hydraulic and explosively set forms of FIGS. 7B, 7C–14 is similar to that above described, except the slip means 76, 76' are sequentially set so that the upper row is set first as will be described in greater detail hereinafter.

In the operation of the mechanical form of FIGS. 7A and 8–14, after the packer arrangement has been lowered in the well bore and the inner tubular member I rotated to disconnect it from housing 110', the slips 120 are set against the tubular member by pulling up on the setting string WS to move the packer arrangement up relative to housing 110' which urges conical surface 121 against slips 120 and moves the slips outwardly to secure housing 110' and outer member O with the well bore tubular member T.

As inner tubular member I is moved up relative to outer tubular member O, after shearing pin 35 as previously described, the slip cage C with slip rows 76, 76' is urged up by inner tubular member I. Portions 131, 133 along with packer P which is between the end **131*a* of portion 131 and end 133*a* of portion 133 are moved therewith. The packer P extends along or is supported on portion 131** as shown.

This causes the upper row 76 of slip segments to be moved outwardly by surface 125 to secure with tubular member T prior to the lower row 76'. Thereafter still additional tension shears pin 130 and the inner tubular member I with conical surface 126 is then urged up to move surface 126 against the lower row 76' of slip segments so that they move outwardly into securing relationship with tubular member T as shown in FIG. 9B.

Still further tension shears pin 132 so that inner member I continues to move up causing packer P to be compressed between shoulders 131*a* and 133*a*, since space 134 accommodates movement of sleeve 133*f* and connected portion 133 relative to portion 131 of inner member I. The lock means L will hold the inner member I in its final position against downward movement after the packer and slips are set, since, as previously noted, the ratchet 40 on the inner member I moves up through lock ring 48, but cannot move down when the lock means L is in the position shown in FIGS. 2A and 9A.

The setting string and setting tool may then be releases from the inner member and set packer arrangement by shearing shear ring 21 by still additional tension, or by rotating to unthread at shear ring 21. The shear and thread ring 21 provides connecting means for connecting the inner tubular member I with the setting string WS and disconnect means to disconnect the setting tool and setting string from the set packer arrangement in all forms of the invention. The setting tool is then pulled up by the setting string to abut the shoulder 140 with shoulder 141, which movement elevates annular recessed portion 142 to align with the slips 120 whereby the radially movable conical surface portion 121 may retract inwardly to well bore tubular member T and move into recess 142 to release the slips 120 as the setting string is pulled up. The engagement of shoulders 140, 141 removes the setting tool, housing 110' and connected adapter A from the packer arrangement and exposes the seal surface 38 projecting above the outer member for engagement by the production string PS which may be lowered into the well bore after the setting string is retrieved.

The external seal surface 38 is provided with a releasable connection RC in the form of a J-slot 98 adjacent its lower end to receive the pin 99 on production string PS as shown in FIG. 10. Also, the inner member I adjacent its upper end is provided with an internal annular groove 38' to receive a retrievable plug shown in dotted line at 145 in FIG. 10.

The external seal connection with the production string PS does not interfere with placement and removal of the plug as desired and similarly the arrangement of the external grapple surface means 100 adjacent the upper end of the outer member O and below the production string does not interfere with the production string connection and disconnection and also enables the packer arrangement to be released and retrieved without first removing plug 145.

The function of the hydraulic form shown in FIG. 7B and the explosively actuated form of FIG. 7C is similar to that above described except the mechanical setting tool details shown in FIG. 8 are not employed.

The setting string and setting tool of FIGS. 7B and 7C and FIGS. 1A–1C are connected directly to the inner tubular member I as schematically shown depending upon which form, hydraulic or explosively set is to be used. Where hydraulics are employed, the fluid is supplied through the coiled tubing CT and discharged into inner member I after the ball B has been first inserted and seated on ball seat BS to close off inner member I. The fluid is then directed through port 146 to act down on piston 147 and outer member O with a resultant upward force on member I to shear pin 35. Further pressure moves outer tubular member O down and creates an up reactive force on member I to expand upper slips into contact with the tubular member T in the FIG. 7B, 7C form. Thereafter additional pressure shears pin 130 and the lower row 76 of slips set against tubular member T. Shear pin 132 then shears upon additional pressure and enables packer P to be sealingly set as described with regard to FIG. 8. In the FIGS. 1A–1C form, both slip rows are simultaneously actuated. After the packer is set, additional hydraulic pressure shears ring 21 and the setting tool ST and adapter A are retrieved from the set packer arrangement to expose external seal surface 38 on inner member I for connection with the production string as previously described. As noted above, the actuation of the explosively actuated setting tool of FIGS. 1A and 7C is as above described with regard to the hydraulic form.

In the mechanical form, the packer arrangement is set by the setting tool by up pulls or tension in the setting string to stepwise increase tension to sequentially shear member 35, 130, 132 and 21; in the hydraulic form the hydraulic pressure acts to move outer tubular member down and causes an up force on the inner member I with increased pressure increments to also stepwise shear member 35, 130, 132 and 21; the actuation of the explosively actuated form causes a similar relationship to forces to that which occurs with the hydraulic form, but the events may occur more rapidly.

Release and subsequent retrieval of all forms of the packer arrangement is effected by actuating release means 58.

Grapple surface means 100 are provided on the external upper end of the outer member as shown, which grapple surface means may assume any configuration for conformably receiving and engaging with a grapple means 100' shown in FIGS. 5A and 11A. As shown, the grapple surface is illustrated as being a ratchet surface 101 which is adapted to engage the ratchet member 103 carried by the grapple means 100'. The member or ring 103 is split or segmented to accommodate movement of the grapple means 100' down over the surface 101, but locks therewith when a tension is applied to the well string which carries the grapple means 100'.

Figure 5B:
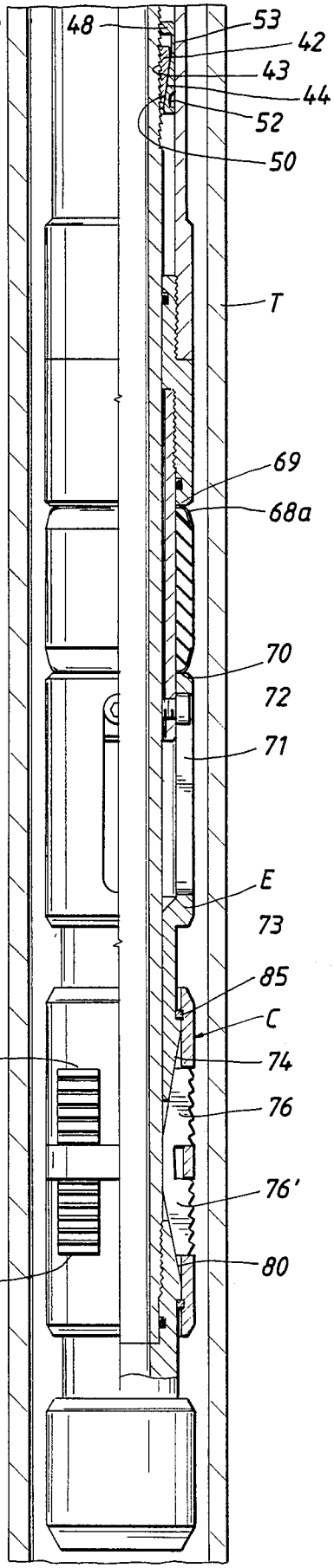

The grapple 100' in the embodiment illustrated is shown as including an overshot or member 105 which may be telescopically received over the upper end of the inner member for engaging with the external upper end of the sleeve means 58 and when tension is applied thereto the shear pin 59 is sheared to then accommodate relative longitudinal movement between the sleeve or release meams 58 and the remainder of the outer member O. When the sleeve means 58 shifts upwardly in response to tension in the well string or operating string OS, the lock ring 54 moves or is urged outwardly into the space in the outer member O beneath the lower shoulder 64 of upwardly shifted sleeve 58 as shown in FIGS. 5A and 11A. Movement of the lock ring 54 out of the groove 52 disconnects the lock means L from the outer member to enable a pull or tension to be applied to the outer member O by the grapple tool to release the slip rows 76, 76' from securing relationship with the tubular member T and thus enable the packer P to move to retracted position as illustrated in FIGS. 5B and 11B. If the application of the tension force by the operating string OS as described does not completely release the slip segments from tubular member T, the pin 110 between overshot 105 and the operating string OS may be sheared by moving the operating string downwardly to release it for longitudinal movement relative to the overshot member 105. Thereupon a downward jar may be applied by the surface 14 on the lower end of the operating string to the upper end 7 of the inner member I as shown in FIGS. 5A and 11A to further assist in releasing the rows of slip segments 76, 76' from the tubular member T. The shoulders 111, 112 enable an upward jar to be applied to the inner member I. Thus, selective tension and compression forces may be applied respectively to the outer member O and inner I to effect release from the tubular member T for retrieval. The operating string OS remains coupled to overshot 105 by reason of the shoulders 111, 112 so that the packer arrangement on inner member I may be retrieved from the well bore along with the operating string.

It is believed that the setting and retrieval of the disclosed forms is understood from the foregoing description. As noted, the mechanical setting form of FIGS. 7A and 8–8B employs the housing 110' to enable the setting string and tool to be manipulated to set the slip rows sequentially and then the packer by stepwise increasing the tension.

Release and retrieval also involves further tension so that apart from the initial rotational release of the setting tool and inner tubular member from the housing 110', setting and retrieval is accomplished by tension sequentially applied in the setting string.

In the hydraulic and explosively actuated form of setting tool employed with the packer arrangement of FIGS. 1A–1C, 7B, 8A and 8B pressure is sequentially applied to set the slips and packer in a manner, or sequence as desired and then set the packer. Release is accomplished as above described.

It should be noted that sequential setting of the slips in the packer arrangement of FIGS. 1A–1C, 2A and 2B by hydraulic and explosive setting tools is not contemplated. Where a mechanical setting tool is employed the packer should by below the slips as shown in FIGS. 7A, 8A and 8B and the sequential setting of slip rows 76, 76' is preferential to assure proper setting of the packer.

Also the packer below the slips as shown in FIGS. 8A and 8B seals off the slips thereabove and prevents well fluid from the well bore beneath the packer from contacting the slips and causing them to corrode or possibly bind to remove even after a substantial period of years in the well bore.

While the present invention may be employed in any size tubular member it has particular utility in connection with smaller tubular members such as tubing employed for production strings in well bores. The arrangement of the components of the packer arrangement of the present invention enables it to be positioned and sealably anchored in relatively small internal diameter tubular members, and the arrangement of the external grapple surface engaging means enables it to be released from its anchored position by engaging adjacent the upper end of the packer.

Further, the present invention has utility in that it may act as a plug to plug off flow through a tubular member merely by employing an inner member that has no flow passage therethrough.

It may also be employed to retrievably position instruments and other devices in well bore tubular members which have no landing shoulder means to receive and support the instruments and devices, or where the landing shoulder means of the tublar member is inoperative for any reason, such as by way of example, damage or corrosion.

In oil and gas well tubular members which are provided with a profile or a landing shoulder of some type, it has been customary to provide a lock mandrel of well know form with means which seats in the profile, or groove, to enable various devices to be positioned in the landing nipple for accomplishing various functions in the well. However, many oil and gas well have been completed in which the tubular members have not been provided with a profile for receipt of means to engage in the profile and sealably position a retrievable lock mandrel in the tubular member.

Also the groove or profile may become worn, damaged or corroded over a period of time so that it is inoperative. The present invention overcomes this disadvantage in that landing nipple means, one form of which is as illustrated generally at LN in FIG. 15 of the drawings may be connected to the lower end of the inner member I of the retrievable packer arrangement of the present invention, which packer arrangement is represented generally by the letter P' in FIG. 15. It can be appreciated that packer arrangement P' includes the components of the present invention such as, by way of example, as shown in FIGS. 1–14 and as heretofore described.

The landing nipple means LN includes upper and lower landing nipple means and upper and lower tubing nipple means and a perforated nipple. It can be appreciated that the landing nipple means configuration and form can be varied to accomplish any results desired. The upper tubing nipple 150 is provided with threads at each end and its upper end is threadedly engaged with the lower end of the inner member I of the packer arrangement of FIGS. 1–14.

Figure 15:
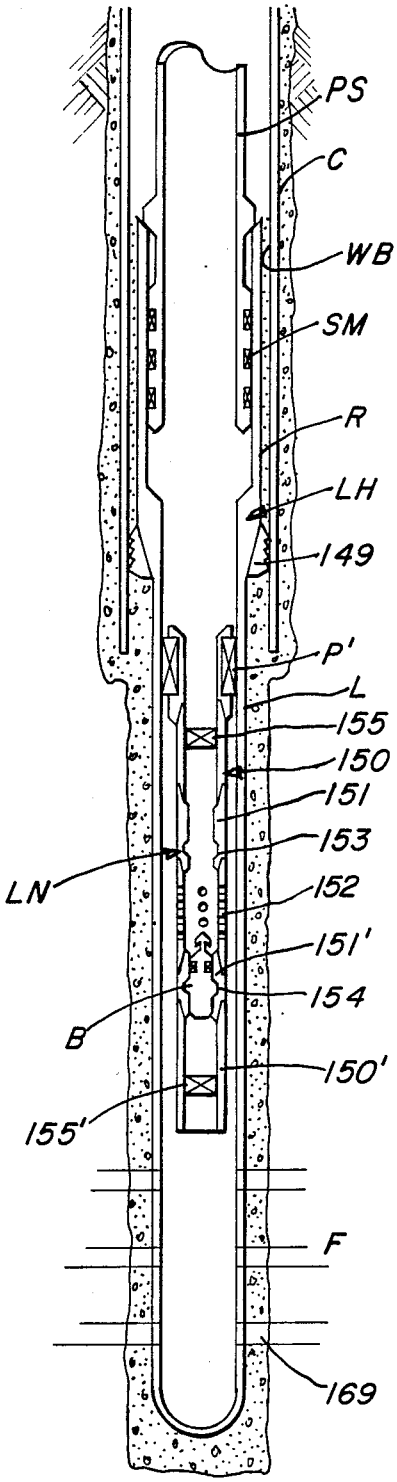
FIG. 15 is a schematic view illustrating a well bore with a casing, a liner supported therein with an upwardly facing tubular member such as a packer bore receptacle and the packer arrangement of the present invention having connected therewith a landing nipple which is sealably secured in position in the liner.

The upper landing nipple 151 is connected with the lower end of upper tubing nipple 150 and depends therefrom. An annular groove or profile 153 is provided therein as illustrated. As shown in FIG. 15, the perforated tubing nipple 152 is threadedly secured with and depends from the upper landing nipple 151, and the lower landing nipple 151' is connected to and depends from the perforated tubing nipple 152. The lower landing nipple 151' is provided in its internal bore with annular groove and profile 154 as shown.

The lower tubing nipple 150' is secured to and depends from lower landing nipple 154 as illustrated in FIG. 15.

FIG. 15 illustrates a well bore WB which is provided with a casing designated as C. A liner L is secured within the casing C and depends or extends downwardly therefrom. The liner L is supported on the casing by any suitable means such as the liner hanger referred to generally by the letters LH which may be of any suitable well known form such as a mechanical actuated form or a hydraulically actuated form as desired.

In FIG. 15 the slips 149 of a liner hanger are illustrated that function in a well known manner to support the liner L on the casing C.

The liner L forms an upwardly opening or upwardly facing receptacle and includes an extension designated H commonly referred to as a packer bore receptacle.

A string of tubular members extends from the earth's surface into the well bore WB to form what is normally termed a production string designated PS and is of smaller internal diameter than the internal diameter of the upwardly facing or upwardly opening receptacle R. Seal means of any suitable form referred to by the letters SM are provided either on the production string PS lower end or within the receptacle R to form a sealing relationship between the lower end of the production string PS and the packer bore receptacle R. This accommodates longitudinal movement of the production string relative to the retrievable receptacle while maintaining a seal therebetween.

As noted previously the packer arrangement P' in FIG. 15 of course includes the construction and arrangement of the packer described in FIGS. 1–14 including the inner and outer member with a packer means and slips as described with regard thereto.

In using the present invention as illustrated in FIG. 15, the well bore is drilled, the casing C is positioned therein and thereafter the liner L is hung on the casing C in a manner well known in the art.

Where the packer arrangement of the present invention is employed to position a landing nipple in the liner L, the packer arrangement P' and landing nipple LN are usually positioned in the liner L before the production string PS is sealably engaged with the packer bore receptacle R.

When a profile 153 is not present, or if present, but inoperative, and it is desired to shut off flow from the formation represented by the letter F in order to accomplish desired servicing operations in the well bore, a packer such as shown and described in FIGS. 1–14, but smaller in size may be sealably in the upper tubing nipple 150 as represented at 155 to function as a plug and close off flow from the formation F to the production string PS. Alternatively, if the upper landing nipple 151 is provided with an operative profile 153, a plug of a well known form may be lowered to seat in profile 153 so as to close off flow from perforations 169 which communicate the formation F with the production string PS through the perforated nipple 152.

Thereafter the production string PS may be either removed from the well bore, or withdrawn from sealing engagement with the packer bore receptacle so as to conduct whatever servicing operations may be desired such as circulations of fluids within the well, or other operations as desired.

In some situations it may be desirable to temporarily or permanently position suitable retrievable instrument means such as a pressure bomb or temperature bomb represented by the letter B in the lower landing nipple. The instrument means B is provided with suitable well known means for engaging with a profile 154 when such profile is present and operative in the lower landing nipple. Also, a suitable fishing neck is provided on the instrument means B for engagement and retrievable from the well bore as desired.

Where the profile 154 is not present or not operative to seat instrument means B, the instrument means B may be supported by a smaller size of the packer arrangement P' of the present invention to anchor the instrument means B in the lower tubing nipple 150'. In such event a smaller size of the packer arrangement P' could be lowered with instrument means B secured therewith and sealably anchored as represented at 155' in the lower tubing nipple.

If it is desired to remove the landing nipple means LN, the production string PS is removed from the well bore. The packer arrangement P' of the present invention includes surface means on the inner and outer member upper ends as illustrated in FIG. 5 of the drawings so that upward and downward selective jarring impacts may be imparted to the inner and outer members to disengage the slips from their respective conical surfaces in the packer arrangement to aid in moving the expanded packer to retracted position for retrieval from the liner L. Also, as previously noted, the packer arrangement P' can be set and retrieved by wireline which is of substantial advantage when the packer arrangement is used in small diameters.

In FIG. 16 the casing C is again represented and is provided with a production string again represented by the letter PS with a production packer of any suitable configuration and arrangement illustrated generally by 160.

Heretofore, it has been customary to provide a profile or groove for receiving a plug that may be lowered into the production string and seated in the profile if it is desired to block flow therethrough or to suspend instruments within the tubing.

Figure 16:
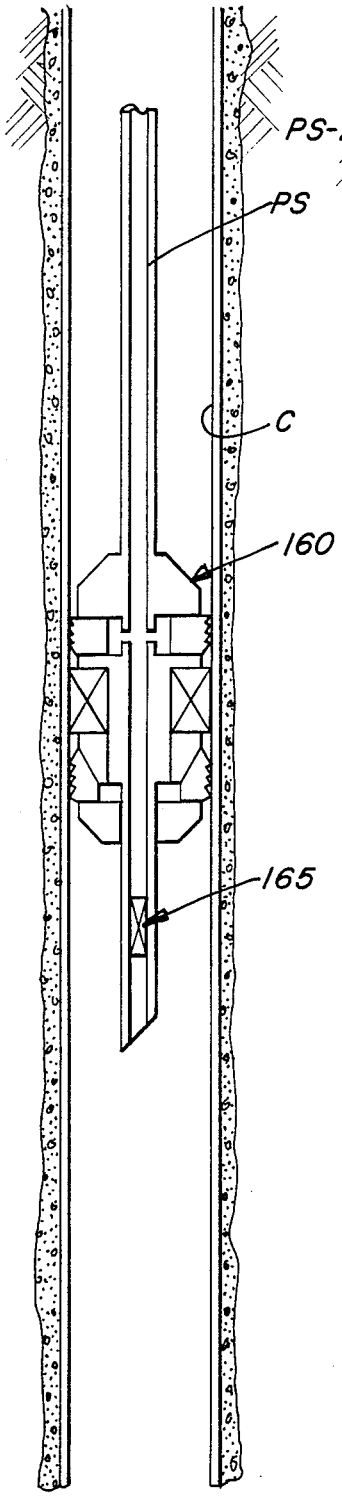
FIG. 16 illustrates a well bore with a production packer between a casing and a single production string with the packer arrangement of the present invention positioned as a plug in the production string.

In those instances where no profile has been provided in a production string or if provided, but inoperative, the packer arrangement P' of the present invention may be lowered through the production string PS and actuated to expand into sealing and anchoring relationship within the tubular member as represented at 165 in FIG. 16 of the drawings. The packer 165 may function as a plug, or to support any suitable means such as by way of example only instrument means as described with regard to FIG. 15.

Heretofore, it has been extremely difficult, if not impossible in some situations to remove a packer from a tubular member in a well bore without drilling or milling or cutting it out in some fashion.

The packer arrangement P' of the present invention overcomes this problem in that it provides surface means on each the inner and outer members with which a grapple tool such as described hereinabove may be engaged so as to selectively impart upward and downward jarring impacts above the seated packer to disengage the anchored slips from the tubular member and from their respective upwardly and downwardly facing conical surfaces for retrieval of the packer arrangement.

Figure 17:
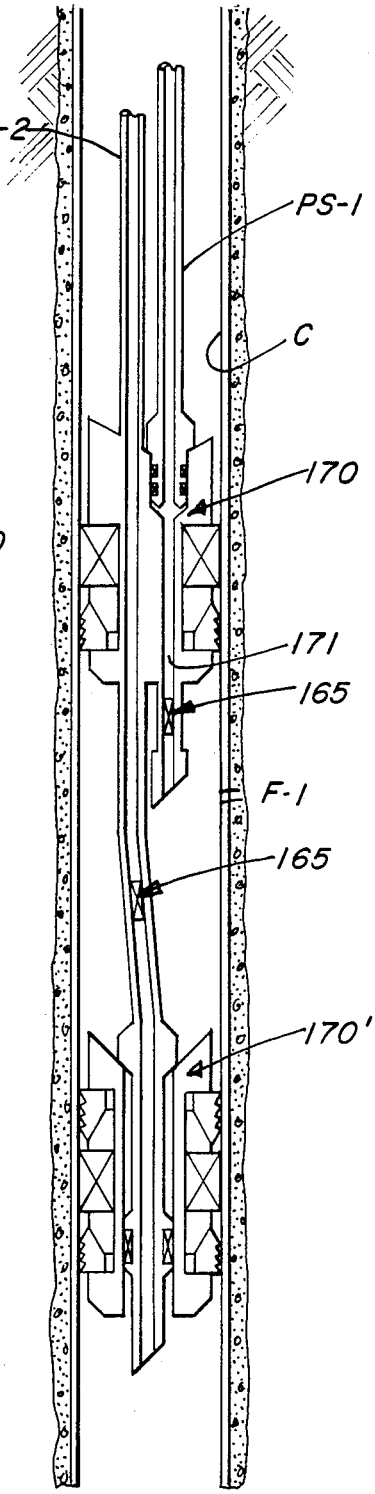
FIG. 17 is a view similar to FIG. 16 and schematically illustrates a dual flow production packer arrangement with dual flow production strings associated therewith and the packer arrangement of the present invention positioned to control communication through each of the production strings as desired.

In FIG. 17 a casing C is again illustrated with a dual production packer of well known form represented generally at 170 with a pair of production strings associaated therewith again represented respectively by PS-1 and PS-2.

It will be noted that production string PS-1 is sealably received in the production packer 170 as illustrated and a passage 171 is provided in the production packer 170 for conducting flow from a formation such as F-1 into production string PS-1.

The packer arrangement P of the present invention is again illustrated at 165 as seated within the passage 171 of the production packer when it is desired to seal off the flow therethrough or to suspend instruments within the tubing from the packer 165.

Similarly, production string PS-2 is sealably received in production packer 170' as illustrated and it may also be selectively provided with the packer arrangement P of the present invention again represented, anchored and sealed at 165.

In instances where it is desired to seat a packer at any desired elevation and maintain ease of setting as well as retrieval, the present packer arrangement is particularly useful in that it provides an external grapple surface which may be engaged to assist in packer slip release without engaging internally in the packer arrangement. Also, the packer can be provided in relataively small diameters while still employing the beneficial structural arrangement of its component to assist in ease of positioning and retrieval.

Additionally the fact that the present packer arrangement may be selectively set either mechanically, hydraulically or by an explosive wire line actuated tool means is particularly useful as well as the fact that it can be retrieved by a grapple tool supported on either coupled pipe, coiled pipe or a wire line as desired.

From the foregoing description, it can be seen that the present invention enables the same simple compression type packer to be sealingly set and secured in position in a tubular member by either a hydraulic, mechanical or wireline setting tool and it can be released and retrieved without milling, and without attempting to insert any tool in the packer arrangement to effect release by either coupled or coiled tubing or a wireline grapple.

The foregoing disclosure and description of the invention are illustrative and explanatory thereof, and various changes in size, shape and materials as well as in the details of the illustrated construction may be made without departing from the spirit of the invention.

What is claimed is:

1. A well bore tubular member retrievable packer arrangement for connection with either mechanically, hydraulically or wire line explosively actuated setting tool means retrievably supported on a setting string to sealably secure the packer arrangement with the well bore tubular member to communicate with a production string and which packer arrangement may be retrieved by a grapple tool supported on either coupled pipe, coiled pipe or a wireline comprising:

inner and outer tubular members;

said inner and outer tubular members each having an upper end;

connecting means adjacent the upper end of said inner tubular member for connecting said inner tubular member with the setting tool means;

said inner tubular member having a longitudinally extending, annular external surface adjacent its upper end;

adapter means supported by the retrievable setting tool means and surrounding said annular external surface on said inner tubular member;

securing means securing said inner and outer tubular members against relative movement as they are lowered into the well bore, said securing means releasable upon relative movement between said inner and outer tubular members;

packer means supported on at least one of said tubular members and expandable into sealing engagement with the well bore tubular member upon relative longitudinal movement between said inner and outer tubular members;

slip means for engaging the well bore tubular member upon relative longitudinal movement between said inner and outer tubular members to secure the packer arrangement in expanded, sealed engagement with the well bore tubular member;

cooperating lock means on said inner and outer tubular members to lock said inner and outer tubular members in their longitudinally moved relationship to aid in maintaining said packer means secured in expanded, sealed engagement with the well bore tubular member;

disconnect means responsive to manipulation of the setting string for disconnecting the retrievable setting tool means and adapter from said inner tubular member whereby the setting tool means and said adapter may be withdrawn by the setting string to expose said external surface on said inner tubular member for sealably receiving the production string therearound; and external grapple surface engaging means on the external surface of said outer tubular member for engagement by the grapple tool to retrieve the packer arrangement from the well bore tubular member.

2. A well bore tubular member retrievable packer arrangement for connection with an actuatable by either mechanically, hydraulically or wireline explosively actuated setting tool means retrievably supported on a setting string to sealably secure the packer arrangement with the well bore tubular member to communicate with a production string and which packer arrangement may be retrieved by a grapple tool supported on either coupled pipe, coiled pipe or a wireline comprising:

inner and outer tubular members;

said inner and outer tubular members each having an upper end;

connecting means adjacent the upper end of said inner tubular member for connecting said inner tubular member with the setting tool means;

securing means securing said inner and outer tubular members against relative movement as they are lowered into the well bore, said securing means releasable upon relative movement between said inner and outer members;

slip means for engaging the well bore tubular member upon relative longitudinal movement between said inner and outer tubular members to secure the packer arrangement in expanded, sealed engagement with the well bore tubular member;

packer means supported on said inner tubular member below said slip means and expandable into sealing engagement with the well bore tubular member upon relative longitudinal movement between said inner and outer tubular members to seal off the well bore below said packet means from said slip means;

cooperating lock means on said inner and outer tubular members to lock said inner and outer tubular members in their longitudinally moved relationship to aid in maintaining said packer means secured in expanded, sealed engagement with the well bore tubular member;

said inner tubular member having a longitudinally extending, annular external surface adjacent its upper end;

disconnect means responsive to manipulation of the setting string for disconnecting and removing the setting tool means from said inner tubular member: and external grapple surface engaging means on the external surface of said outer tubular member for engagement by the grapple tool to retrieve the packer arrangement from the well bore tubular member.

3. A well bore tubular member retrievable packer arrangement for connection with either hydraulically or wireline explosively actuated setting tool means retrievably supported on a setting string to sealably secure the packer arrangement with the well bore tubular member to communicate with a production string and which packer arrangement may be retrieved by a grapple tool supported on either coupled pipe, coiled pipe or a wireline comprising:

inner and outer tubular members;

said inner and outer tubular members each having an upper end;

connecting means adjacent the upper end of said inner tubular member for connecting said inner tubular member with the setting tool means;

said inner tubular member having a longitudinally extending, annular external surface adjacent its upper end;

adapter means supported by the retrievable setting tool means and surrounding said annular external surface on said inner tubular member;

securing means securing said inner and outer tubular members against relative movement as they are lowered into the well bore, said securing means releasable upon actuation of the setting tool to accommodate relative longitudinal movement between said inner and outer tubular members;

slip means supported for engaging the well bore tubular member upon relative longitudinal movement between said inner and outer tubular members to secure the packer arrangement in expanded, sealed engagement with the well bore tubular member;

packer means supported on said outer tubular member above said slip means and expandable into sealing engagement with the well bore tubular member upon relative longitudinal movement between said inner and outer tubular members;

cooperating lock means on said inner and outer tubular members to lock said inner and outer tubular members in their longitudinally moved relationship to aid in maintaining said packer means secured in expanded, sealed engagement with the well bore tubular member;

disconnect means responsive to manipulation of the setting string for disconnecting the retrievable setting tool means and adapter from said inner tubular member whereby said setting tool means may be withdrawn by the setting string to expose said external surface on said inner tubular member for sealably receiving the production string therearound; and external grapple surface engaging means on the external surface of said outer tubular member for engagement by the grapple tool to retrieve the packer arrangement from the well bore tubular member.

4. A packer arrangement for connection with hydraulically or wireline explosively actuated setting tool means retrievably supported on a setting string to sealably secure the packer arrangement in a well bore tubular member to extend upwardly into a production string and which is retrievable by a grapple tool supported on either coupled pipe, coiled pipe or a wireline comprising:

inner and outer tubular members:

said inner and outer tubular members each having an upper end:

connecting means adjacent the upper end of said inner tubular member for connecting said inner tubular member with the setting tool means:

said inner tubular member having a longitudinally extending annular external surface adjacent its upper end:

adapter means supported by the retrievable setting tool means and surrounding said annular external surface on said inner tubular member:

securing means securing said inner and outer tubular members against relative movement as they are lowered into the well bore, said securing means releasable upon actuation of the setting tool to accommodate relative longitudinal movement between said inner and outer tubular members:

slip means for engaging the well bore tubular member upon relative longitudinal movement between said inner and outer tubular members to secure the packer arrangement in expanded, sealed engagement with the well bore tubular member;

packer means below said slip means and expandable into sealing engagement with the well bore tubular member upon relative longitudinal movement between said inner and outer tubular members;

cooperating lock means on said inner and outer tubular members to lock said inner and outer tubular members in their lingitudinally moved relationship to aid in maintaining said packer means secured in expanded, sealed engagement with the well bore tubular member;

disconnect means for disconnecting the retrievable setting tool means from said inner tubular member whereby the setting tool means may be withdrawn by the setting string to expose said external surface on said inner tubular member for sealably receiving the production string therearound; and external grapple engaging surface means on the external surface of said outer tubular member for engagement by the grapple tool to retrieve the packer arrangement from the well bore tubular member.

5. A packer arrangement for connection with and actuatable by mechanically actuated setting tool means retrievably supported on a setting string to sealably secure the packer arrangement in a well bore tubular member to extend upwardly into a production string and which is retrievable by a grapple tool supported on either coupled pipe, coiled pipe or a wireline comprising:

inner and outer tubular members;

said inner and outer tubular members each having an upper end and a lower end;

means releasably connecting said inner tubular member with the setting string;

said inner tubular member having an annular longitudinally extending external seal engaging surface adjacent its upper end;

said setting tool means including housing means; connecting means for releasably connecting said housing means with said setting tool means;

adapter means supported by said housing means and surrounding said annular external surface on said inner tubular member;

conical surface means on said adapter means;

said housing means including drag block means and slip means whereby engagement of said drag block means with the well bore tubular member enables said releasable connecting means to be actuated by manipulating the setting string to release said housing means from said inner member and engage said conical surface means on said adapter means with said slip means to secure said housing means to the well bore tubular member;

shear means connecting said inner and outer tubular members together, said shear means releasable upon longitudinal movement of said inner member after said housing means is secured to the well bore tubular member;

additional slip means supported for moving outwardly relative to said inner and outer tubular members to engage and secure with the well bore tubular member when said inner member is moved up relative to said housing means and outer tubular member;

packer means below said additional slip means which is expandable into sealing engagement with the well bore tubular member upon longitudinal movement of said inner tubular member relative to said housing means and outer tubular member;

cooperating lock means on said inner and outer tubular members to lock said inner and outer tubular members when said packer means is in sealed engagement with the well bore tubular member and to maintain said packer means secured in expanded, sealed engagement with the well bore tubular member;

said releasable connection means responsive to manipulation of the setting string to reconnect said housing means with the setting string for removal of said housing means and adapter means from adjacent said inner tubular member to expose said external surface on said inner tubular member for sealably receiving the production string therearound; and external grapple engaging surface means on the external surface of and adjacent the upper end of said tubular member for engagement by the grapple tool to retrieve the packer arrangement from the well bore tubular member.

6. The packer arrangement of claims 1, or 2, or 3, or 4, or 5 wherein said cooperating lock means includes:

a ratchet surface on said inner tubular member;

a ratchet ring between said inner and outer tubular members, said ratchet ring having a least one tapered outer surface;

a ratchet ring support between said inner and outer tubular members, said support ring having an outer tubular surface with a groove therein and at least one inner tapered surface abutting said ratchet ring outer tapered surface; and a lock ring in the groove to aid in retaining said support and ratchet ring engaged with said ratchet surface.

7. A method of positioning a retrievable packer arrangement in a well bore tubular member by a setting string wherein the packer arrangement includes an inner tubular member connected with the setting string, an outer tubular member with external engageable release surface means adjacent its upper end and operable to release the set packer arrangement, packer means and slip means for sealably securing with the well bore tubular member, lock means to lock the packer arrangement in sealing relation with the well bore tubular member and which lock means can be unlocked by the external release surface means comprising the steps of:

releasably securing the inner and outer members against relative longitudinal movement;

manipulating the setting string to release the inner and outer members for relative longitudinal movement which moves the packer means and slip means into sealing and securing relationship with the well bore tubular member, positions the external engageable release surface means adjacent the upper end of the outer member for engagement and actuates the lock means to maintain the packer means and slip means in sealed and secured relationship with the well bore tubular member; and releasing the setting string from the inner member and removing the setting string from the inner member for retrieval from the well bore to position the external engageable surface means adjacent the outer member upper end for engagement .

8. A method of recovering a packer arrangement set in a well bore tubular member wherein the packer arrangement includes packer means, slip means to secure the packer means in the well bore tubular member and an inner tubular member with an outer tubular member extending through the packer means, the outer tubular member having external release means on the external surface thereof and adjacent its upper end and which release means is operable to release the set packer arrangement from the well bore tubular member comprising the steps of:

lowering grapple means to engage the external release means on the outer tubular member; and manipulating the grapple means to release the slips that secure the set packer arrangement to the well bore tubular member for retrieval of the slips and packer arrangement wherein the manipulation includes applying compression and/or tension forces adjacent the upper end of the inner and outer tubular members to release the slips.

9. A method of securing a packer arrangement in a well bore tubular member by a setting string and retrieving the set packer arrangement by grapple means wherein the packer arrangement includes an inner tubular member with an external seal surface adjacent its upper end within the adapter for sealably receiving thereover a production string when the seal surface is exposed, an outer tubular member with release means adjacent its external upper end and operable to release the secured packer arrangement, packer means and slip means for sealably securing with the well bore tubular member, lock means to lock the packer arrangement in sealing relation with the well bore tubular member and which can be unlocked by the release means comprising the steps of:

releasably securing the inner and outer members against relative longitudinal movement;

disconnecting the inner and outer members for relative longitudinal movement which movement moves the packer means and slip means into sealing and securing relationship with the well bore tubular member, and actuates the lock means to maintain the packer means and slip means in sealed and secured relationship with the well bore tubular member;

releasing the setting string from the inner member and removing the setting string from the well bore to expose the external seal surface on the inner member upper end for sealing engagement with the production string;

lowering a production string into the well bore to sealably engage the external seal surface on the secured packer arrangement;

removing the production string from the well bore;

lowering grapple means into the well bore to telescopically engage the external release means; and selectively applying compressive and/or tension forces adjacent the upper end of the inner and outer members to actuate the release means and slip means to disengage the secured packer arrangement from the well bore tubular member for retrieval.

10. A method of positioning a retrievable packer arrangement in a well bore tubular member a setting tool on a setting string and wherein the packer arrangement includes an inner tubular member, an outer tubular member with external release means thereon operable to release the set packer arrangement, packer means and slip means wherein the slip means includes upper and lower row of slips for sealably securing with the well bore tubular member, lock means to lock the arrangement in sealing relation with the well bore tubular member and which can be unlocked by the release means comprising the steps of:

manipulating the setting tool string to sequentially:

release the inner tubular member from the outer tubular member and secure the outer tubular member to the well bore tubular member;

secure the upper row of slips to the well bore tubular member; secure the lower row of slips to the well bore tubular member;

expand the packer means into sealing engagement with the well bore tubular member;

actuate the lock means to lock the rows of slips and packer means in sealed, secured relation with the well bore tubular member; and remove the setting tool and setting string from the inner member to position the external release means for engagement.

11. A method of positioning a retrievable packer arrangement in a well bore tubular member for sealably receiving over its upper end a production string, wherein the arrangement includes inner and outer members with packer means and slip means for sealably securing with the tubular member, lock means to lock the arrangement in sealing relation with the tubular member and release means to release the lock means comprising the steps of:

releasably securing the inner and outer members against relative longitudinal movement;

manipulating the inner member to release it from the outer member for relative longitudinal movement;

effecting relative longitudinal movement between the inner and outer members to move the packer means and slip means into sealing and securing relationship with the well bore tubular member and to actuate the lock means to maintain the packer means and slip means in sealed and secured relationship with the tubular member; and selectively applying compressive and tension forces adjacent the upper end of the inner and outer members to actuate the release means and slip means to disengage the packer means from the tubular member for retrieval.

12. The packer arrangement of claim 5 wherein said additional slip means comprises upper and lower rows of slips supported in cage means and wherein said cage means adjacent said lower row of slip means is secured to said inner tubular member by shear means whereby longitudinal movement of said inner tubular member causes said cage means and lower row of slips to move together and actuate said upper row of slips to secure with the well bore tubular member prior to said lower row of slips.

13. The packer arrangement of claim 12 wherein said packer means is supported on said inner member by a slip connection, said slip connection being secured to said inner member by shear means to retain said packer means in retracted position until both rows of said slips are secured with the well bore tubular member, said shear means and slip connection being releasable after said slip rows have secured with the well bore tubular member whereby longitudinal up movement of said inner member actuates said slip connection to compress and expand said packer means into sealing relation with the well bore tubular member.

14. The packer arrangement of claim 5 wherein said slip means comprises:

upper and lower rows of slips;

means to sequentially secure said rows of slips to the well bore tubular member in a predetermined manner;

means to retain said packer means in retracted position until said slip rows have been sequentially secured to the well bore tubular member; and means to expand said packer means into sealing engagement with the well bore tubular member after said slip rows have been secured to the well bore tubular member.

15. A packer arrangement for connection with an actuatable by mechanical setting tool means supported on a setting string to sealably secure the packer arrangement in a well bore tubular member to extend upwardly into a production string and which is retrievable by a grapple tool supported on either coupled pipe, coiled pipe or a wireline comprising:

inner and outer tubular members;

said inner and outer tubular members each having an upper end and a lower end;

means releasably connecting said inner tubular member with the setting string;

said setting tool means including housing means;

conical surface means supported on said outer tubular member adjacent said housing means;

connecting means releasably connecting said housing means with said setting tool means;

said housing means including drag block means and slip means whereby engagement of said drag block means with the well bore tubulara member enables said releasable connecting means to be actuated by manipulating the setting string to release said housing means from said inner member and engage said conical surface means supported on said outer tubular member with said slip means to secure said housing means to the well bore tubular member;

shear means connecting said inner and outer tubular members together, said shear means releasable upon longitudinal movement of said inner member after said housing means is secured to the well bore tubular member;

additional slip means for securing said housing means and outer tubular member with the well bore tubular member when said inner member is moved upon relative to said outer tubular member;

said additional slip means comprising upper and lower rows of slips supported in cage means and wherein said cage means adjacent said lower row of slip means is secured to said inner tubular member by shear means whereby longitudinal movement of said inner tubular member causes said cage means and lower row of slips to move together and activate said upper row of slips to secure with the well bore tubular member prior to said lower row of slips;

packer means below said additional slip means, said packer means being supported on said inner member by a slip connection, said slip connection being secured to said inner member by shear means to retain said packer means in retracted position until both rows of said slips are secured with the well bore tubular member, said shear means and slip connection being releasable after said slip rows have secured with the well bore tubular member whereby longitudinal up movement of said inner member actuates said slip connection to compress and expand said packer means into sealing relation with the well bore tubular member;

said releasable connection means responsive to manipulation of the setting string to reconnect said housing means with the setting string for removal of said housing means with the setting string; and external grapple engaging surface means on the external surface of said outer tubular member for engagement by the grapple tool to retrieve the packer arrangement from the well bore tubular member.

16. The packer arrangement of claims 1, or 2, or 3, or 5 including means to inhibit release of said cooperating lock means said means to inhibit release including:

sleeve means forming part of, projecting above and telescopically positioned relative to said outer tubular member;

said sleeve means and outer tubular member having upper and lower annular, longitudinally spaced shoulders with the longitudinal space between said shoulders of said outer member being of greater extent than the extent of the longitudinal space between said shoulders on said sleeve means to accommodate relative longitudinal movement between said sleeve means and outer tubular member while preventing separation thereof; sleeve shear means securing said sleeve means and outer tubular member together when said sleeve means lower shoulder abuts said outer tubular member lower shoulder;

said sleeve means having an internal recess adjacent its lower shoulder for receiving and positioning said lock ring on said outer tubular member lower shoulder whereby said release means when in this position inhibits release of said lock means; and said sleeve means responsive to manipulation of said outer tubular member when said grapple engaging surfaace means is engaged by the grapple tool to release said cooperating lock means for retrieval of the packer arrangement for the well bore;

and wherein said grapple engaging surface means is formed on said sleeve means whereby said sleeve means may be engaged and actuated by the grapple tool to break said sleeve shear means and move said sleeve means of said outer tubular member to the second position which releases said lock ring from said outer tubular member lower shoulder and said ratchet support ring whereby relative longitudinal movement between said inner and outer tubular members may be effected to disengage said slip means and packer means form the well bore tubular member for retrieval of the packer arrangement.

17. A method of selectively blocking flow from a formation through the flow passage of a production string that is sealably engaged in an upwardly open receptacle in a well by positioning a retirevable packer with a landing nipple thereon in the production string flow passage comprising the steps of:

securing the landing nipple to the retrievable packer;

lowering the retrievable packer and landing nipple into the production string flow passage;

positioning a retrievable plug in the landing nipple in the production string flow passage to block flow from the formation;

elevating the production string to disengage it from the upwardly open receptacle; and circulating fluid above the plug between the well and production string.

18. The packer arrangement of claim 18 wherein said additional slip means comprises upper and lower rows of slips supported in cage means and wherein said cage means adjacent said lower row of slip means is secured to said inner tubular member by shear means whereby longitudinal movement of said inner tubular member causes said cage means and lower row of slips to move together and activate said upper row of slips to secure with the well bore tubular member prior to said lower row of slips.

19. The packer arrangement of claims 1, or 2, or 3 including means to inhibit release of said cooperating lock means, said means responsive to manipulation of said outer tubular member when said grapple engaging surface means is engaged by the grapple tool to release said cooperating lock means for retrieval of the packer arrangement from the well bore.

20. A retrievable well bore tubular member packer setting and retrieving arrangement for connection with either mechanically, hydraulically or wireline explosively actuated setting tool means retrievably supported on a setting string to sealably secure the packer arrangement in a well bore tubular member, the invention comprising:

inner and outer members each having an upper end;

said inner member having a longitudinally extending, annular external surface adjacent its upper end;

said outer member having external grapple surface engaging means adjacent its upper end;

releasable connecting means connecting the upper end of said inner member with the setting tool means;

packer means supported on at least one of said members and expandable into sealing engagement with the tubulara member;

downwardly facing conical surface means on said outer member;

upwardly facing conical surface means on said inner member;

longitudinally spaced upper and lower rows of slip segments for engaging with said downwardly and upwardly facing conical surface means, respectively, for securing the said packer means in sealed relation with the tubular member;

means to first actuate said upper row of slip segments into securing engagement with the tubular member and then actuate said lower row of slip segments into engagement with the tubular member;

means to accommodate relative longitudinal movement between said inner and outer members to effect expansion of said packer means into sealing relation with the tubular member; cooperating lock means to lock said inner and outer members in their longitudinally moved relationship to maintain said packer means in expanded sealed relationship with the tubular member;

surface means to receive a downwarad jar force on said inner member to release said upwardly facing conical surface from said lower row of slip segments; and said external grapple surface engaging means adapted to impart an upward jar force on said outer member to release said downwardly facing conical surface from said upper row of slip segments for retrieval of said packer means from the tubular member.

21. A retrievable well bore tubular member packer setting and retrieving arrangement for connection with either mechanically, hydraulically or wireline explosively actuated setting tool means retrievably supported on a setting string to sealably secure the packer arrangement in a well bore tubular member, the invention comprising:

inner and outer members each having an upper end;

said inner member having a longitudinally extending, annular external surface adjacent its upper end;

said outer member having external grapple surface engaging means adjacent its upper end;

releasable connecting means connecting the upper end of said inner member with the setting tool means;

packer means supported on at least one of said members and expandable into sealing engagement with the tubular member;

downwardly facing conical surface means on said outer member;

upwardly facing conical surface means on said inner member;

longitudinally spaced upper and lower rows of slip segments for engaging with said downwardly and upwardly facing conical surface means, respectively, for securing the said packer means in sealed relation with the tubular member;

means responsive to up movement of said inner member to sequentially first actuate said upper row of slip segments into securing engagement with the tubular member and then actuate said lower row of slip segments into engagement with the tubular member;

surface means on said inner member responsive to further up movement of said inner member after said rows of slip segments have been secured with the tubular member to expand said packer means into sealing relation with the tubular member;

cooperating lock beans to lock said inner and outer members in their longitudinally moved relationship to maintain said packer means in expanded sealed relationship with the tubular member;

additional surface means to recieve a downward jar force on said inner member to release said upwardly facing conical surface from said lower row of slip segments; and said external grapple surface engaging means adapted to impart an upward jar force on said outer member to release said downwardly facing conical surface from said upper row of slip segments for retrieval of said packer means from the tubular member.

22. A retrievable well bore tubular member packer setting and retrieving arrangement for connection with either mechanically, hydraulically or wireline explosively actuated setting tool means retrievably supported on a setting string to sealably secure the packer arrangement in a well bore tubular member, the invention comprising:

inner and outer members each having an upper end;

said inner member having a longitudinally extending, annular external surface adjacent its upper end;

releasable connecting means connecting the upper end of said inner member with the setting tool means;

packer means supported on a least one of said members and expandable into sealing engagement with the tubular member;

downwardly facing conical surface means on said outer member;

upwardly facing conical surface means on said inner member; longitudinally spaced upper and lower rows of slip segments for engaging with said downwardly and upwardly facing conical surface means, respectively, for securing the said packer means in sealed relation with the tubular member;

means responsive to up movement of said inner member to sequentially first actuate said upper row of slip segments into securing engagement with the tubular member and then actuate said lower row of slip segments into engagement with the tubular member;

surface means on said inner member responsive to further up movement of said inner member after said rows of slip segments have been secured with the tubular member to engage and expand said packer means into sealing relation with the tubular member;

cooperating lock means to lock said inner and outer members in their longitudinally moved relationship to maintain said packer means in expanded sealed relationship with the tubular member; and surface means on each said inner and outer members to selectively receive downward and upward jar forces, respectively, to release said rows of slip segments from their respective conical surfaces for retrieval of said packer means from the tubular member.

23. A method of sealably and releasably securing landing nipple means by a retrievable packer in a well bore well string having a larger diameter than the diameter of a production string positioned in the well string, whereby a retrievable device may be inserted through the production string and sealably and releasably anchored in the landing nipple comprising the steps of:

lowering an upwardly open receptacle into the well bore and securing it to the well string;

positioning an expandable and retrievable packer on a landing nipple and lowering them into the upwardly open receptacle; and actuating the retrievable packer to expand and seal with the upwardly open receptacle to sealably secure the landing nipple in the upwardly open receptacle.

24. The method of claim 28 including the step of lowering a production string into the well string and sealably and removably anchoring it within the upwardly open receptacle above the landing nipple.

25. A method of positioning and retrieving landing nipple means by a retrievable packer in a well having a liner therein comprising the steps of:

securing a retrievable packer and landing nipple means together for lowering into the liner;

actuating the retrievable packer to expand and seal with the liner to sealably anchor landing nipple means therein;

positioning a production string having a smaller internal diameter than the liner in the well;

sealably and releasably engaging the smaller internal diameter production string with the liner above the sealably anchored landing nipple;

disengaging the production string from the liner and retrieving it from the well bore; and releasing the expanded retrievable packer from the liner for retrieval of the landing nipple means from the liner in the well.

26. A method of selectively blocking flow from a formation by positioning a packer and landing nipple in a well having a tubular member whereby well operations may be carried out without killing the well comprising:

positioning a retrievalbe packer and landing nipple together and lowering them into the tubular member;

actuating the retrievable packer to expand and seal with the tubular member sealably achor the landing nipple therein;

positioning a production string having a smaller internal diameter than the tubular member in the well;

sealably and releasably engaging the smaller internal diameter production string with the tubular member above the anchored landing nipple;

lowering an expandable retrievable packer through the production string to a position above or into the landing nipple; and expanding the retrievable packer to seal and anchor within the well to block off flow through the production string.

27. A method of selectively blocking flow from a formation in a wall by positioning a retrievable packer and landing nipple in a well having a tubular member whereby well operations may be carried out without killing the well comprising:

positioning a retrievable packer and landing nipple togehter and lowering them into the tubular member;

actuating the retrievable packer to expand and seal within the tubular member to sealably anchor the landing nipple therein;

positioning a production string having a smaller internal diameter than the tubular member in the well;

sealably and releasably engaging the smaller internal diameter production string with the tubular member above the anchored landing nipple; and lowering a retrievable plug through the production string to sealably anchor in the landing nipple beneath the production string to block flow from the formation.

28. The method of claim 27 including the step of elevating the production string to disengage it from the tubular member.

29. The method of claim 28 including the steps of:

sealably reengaging the production string with the tubular member; and removing the retrievable plug from the well bore.

30. The method of claim 28 including the step of circulating fluid above the plug between the tubular member and production string.

31. A method of positioning and retrieving landing nipple means in a well having an upwardly facing receptacle therein comprising the steps of:

securing a retrievable packer and landing nipple means together and lowering them into the tubular member;

actuating the retrievable packer to expand and seal with the upwardly facing receptacle to sealably anchor the landing nipple means therein;

lowering a production string having a smaller internal diameter than the upwardly facing receptacle to sealably and rreleasably engage within the upwardly facing receptacle above the anchored landing nipple means;

disengaging the production string from the upwardly facing receptacle and retrieving it from the well bore; and actuating the retrievable packer to release it from its expanded position for retrieving the landing nipple means form the well.

32. A method of completing a well having a tubular member by positioning a retrievable packer associated with a retrievable landing nipple means in the tubular member wherein the retrievable packer includes inner and outer members with surfaces for receiving downward and upward jar forces, comprising the steps of:

lowering the retrievable packer and associated retrievable landing nipple means into the tubular member;

actuating the retrievable packer to sealably anchor the landing nipple means in the tubular member; and selectively applying upward and/or downward jar forces to the inner and outer members for releasing the anchored packer and landing nipple means for retrieval.

33. The method of claim 23 including the steps of:

disengaging the production string from the tubular member to carry out operations in the well bore; and removing the landing nipple means from the well bore.

34. A well string arrangement for fluid flow in a casing secured in a well bore in the earth comprising:

a liner secured to said casing and extending longitudinally therebelow for receiving fluid in the well string arrangement.

said liner including an upwardly open receptacle within said casing;

a retrievable packer positioned in said liner having a seal surface exposed thereabove;

landing nipple means supported by said retreivable packer and depending therefrom; and a production string sealably and removably engaged with said seal surface above said retrievable packer.

35. The invention of claims 1, or 2, or 3, or 4, or 5, or 18, or 20, or 21, or 22 including landing nipple means secured with said inner member and depending therefrom.

36. A well string arrangement for fluid flow in a casing secured in a well bore in the earth comprising:

a liner secured to said casing and extending longitudinally therebelow for receiving fluid flow in the well string arrangement;

said liner including an upwardly open receptacle within said casing;

a retrievable packer supported by an inner and an outer member and positioned in said liner;

landing nipple means supported by said retrievable packer and depending therefrom;

said inner member having surface means for receiving downward jarring impact;

said outer member adapted for receiving upward jarring impact; and means for selectively applying upward and downward jar forces to said inner and outer members to release said retrievable packer and landing nipple means for retrieval.

* * * * *